US009603473B2

(12) United States Patent
Stone

(10) Patent No.: US 9,603,473 B2
(45) Date of Patent: Mar. 28, 2017

(54) SANITARY STRAW DISPENSER

(71) Applicant: Daniel B. Stone, Aventura, FL (US)

(72) Inventor: Daniel B. Stone, Aventura, FL (US)

( * ) Notice: Subject to any disclaimer, the term of this patent is extended or adjusted under 35 U.S.C. 154(b) by 67 days.

(21) Appl. No.: 14/702,711

(22) Filed: May 2, 2015

(65) Prior Publication Data

US 2015/0313395 A1 Nov. 5, 2015

Related U.S. Application Data

(60) Provisional application No. 61/987,756, filed on May 2, 2014.

(51) Int. Cl.
*A47G 19/30* (2006.01)

(52) U.S. Cl.
CPC ..... *A47G 21/184* (2013.01)

(58) Field of Classification Search
CPC ..... G07F 11/52; A47G 21/184; A47F 1/04; A47F 1/087; A47F 1/10
USPC ..... 221/254, 192, 13, 195, 97, 194, 253
See application file for complete search history.

(56) References Cited

U.S. PATENT DOCUMENTS 3,968,901 A * 7/1976 Peva, Jr. ..... B65B 61/205 198/406
5,450,980 A * 9/1995 Laidlaw ..... G07F 11/44 221/1
5,509,522 A * 4/1996 Laidlaw ..... G07F 11/44 194/350
2012/0298683 A1* 11/2012 Domit ..... B65D 83/02 221/1
2013/0248555 A1* 9/2013 Klier ..... A47G 21/12 221/254

* cited by examiner

*Primary Examiner* — Timothy Waggoner
*Assistant Examiner* — Ayodeji Ojofeitimi
(74) *Attorney, Agent, or Firm* — Robert S. Alexander; Ferrells, PLLC; Anna L. Kinney

(57) ABSTRACT

An automated dispenser for straws is provided with a housing, a hopper, and a guide tray. The housing has a dispensing slot in an anterior outer wall. The hopper has an upper section with transverse walls and longitudinal walls which converge to define a stacking slot and a substantially horizontal support to support straws beneath the stacking slot. An anterior inner wall, longitudinally extending channel, and posterior wall span the longitudinal walls. The anterior inner wall has an ejection opening and the posterior wall has an access opening each of which adjoin the longitudinally extending channel. A support member and pressing foot within the stacking slot can translate longitudinally and pass through both the ejection opening and the access opening. A guide tray, disposed below the ejection opening, has a location zone, a posterior wall, and an anterior wall. The guide tray urges straws into the dispensing slot projecting upwardly.

23 Claims, 26 Drawing Sheets

34
30
40
42
44
46
48

34a
30
40a
42a
44a
46a
48a
68a 34b
40b
42b
44b
46b
48b
64b
30

CONTROL LOGIC

Figure 33
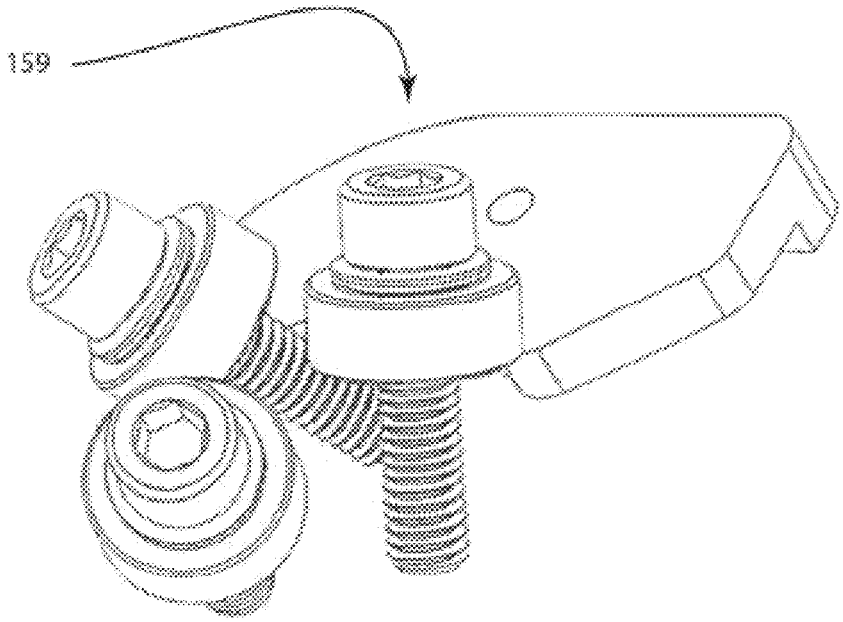
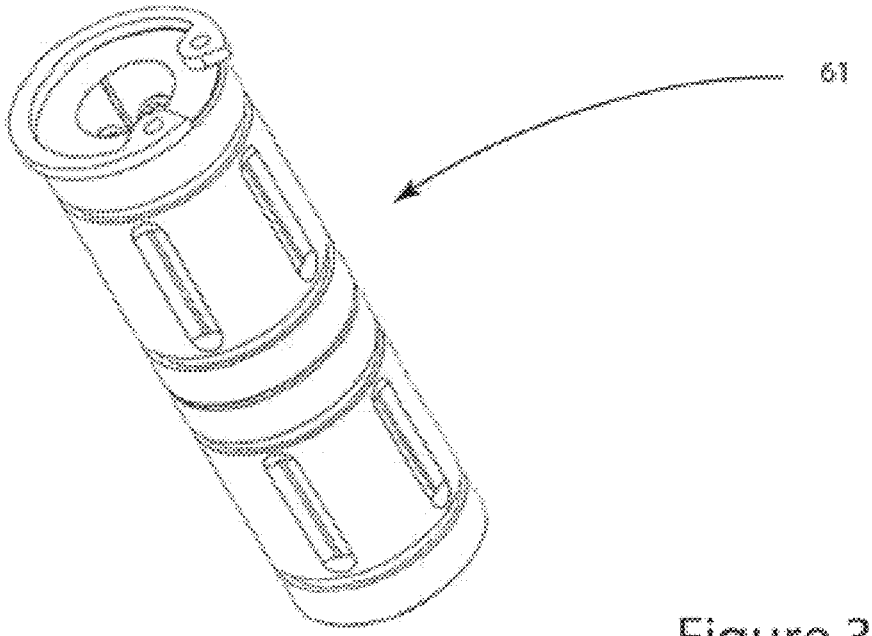
Figure 32

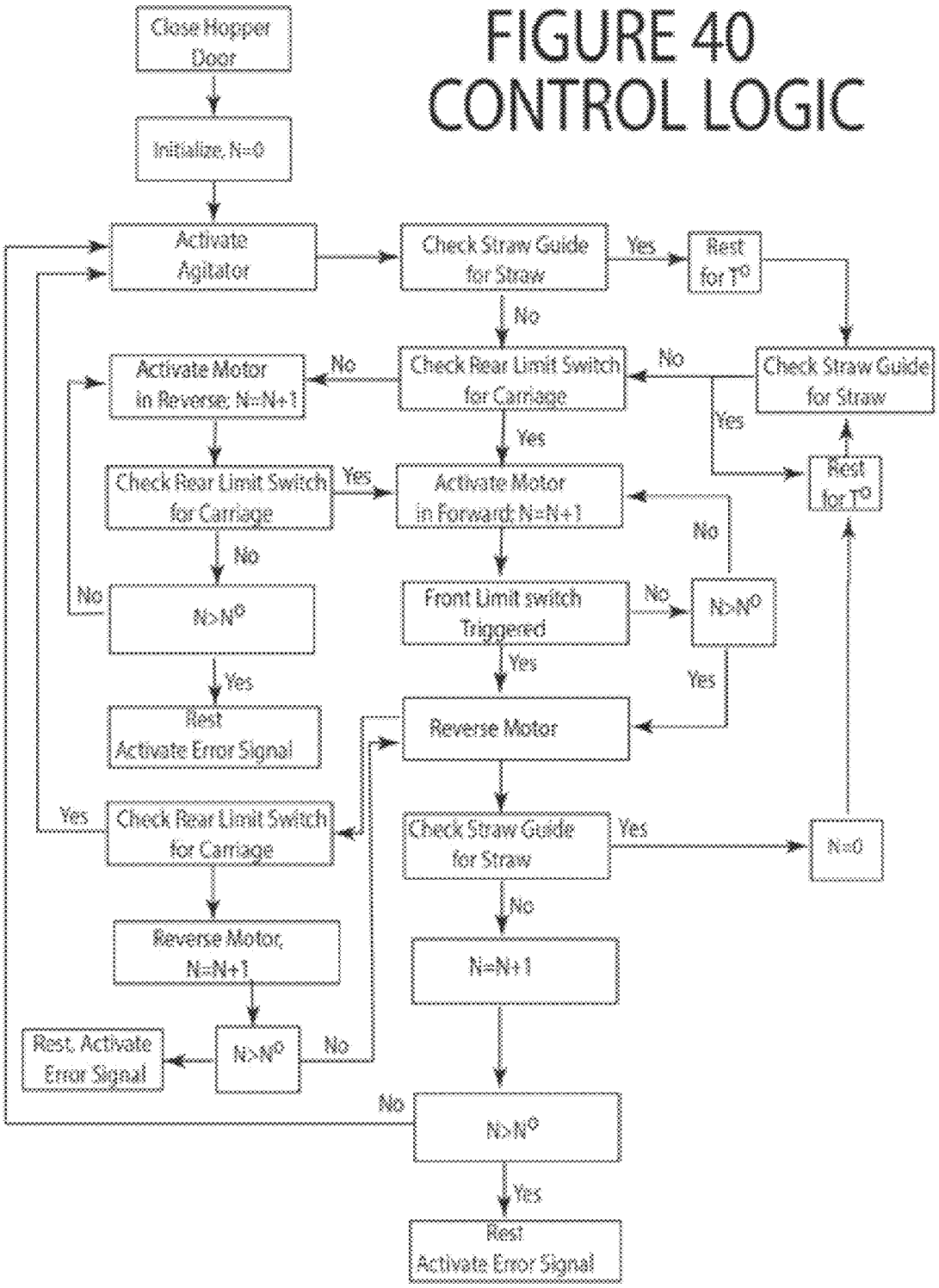
FIGURE 40
CONTROL LOGIC
Close Hopper Door
Initialize, N=0
Activate Agitator
Check Straw Guide for Straw
Yes
Rest for T^Q
No
Check Rear Limit Switch for Carriage
No
Check Straw Guide for Straw
Yes
Activate Motor in Reverse; N=N+1
No
Check Rear Limit Switch for Carriage
Yes
Activate Motor in Forward; N=N+1
Rest for T^Q
No
N>N^Q
No
Front Limit switch Triggered
No
N>N^Q
Yes
Yes
Rest Activate Error Signal
Reverse Motor
Yes
Check Rear Limit Switch for Carriage
Check Straw Guide for Straw
Yes
N=0
Reverse Motor, N=N+1
No
N=N+1
Rest, Activate Error Signal
N>N^Q
No
No
N>N^Q
Yes
Rest Activate Error Signal

SANITARY STRAW DISPENSER

This application claims benefit priority of U.S. Provisional Application 61/987,756 filed May 2, 2014, entitled Sanitary Straw Dispenser naming Daniel Stone as inventor, incorporated herein by reference.

Straws are omnipresent in the quick service restaurant industry being used for the wide variety of soft drinks that account for a large portion of the quick service restaurant owners' margins. Yet even though they inherently come into contact with the customer's drink and the customer's mouth, a truly sanitary and practical method of dispensing straws—often referred to as "soda straws"—has been lacking. This invention relates to an automated straw dispenser that, in preferred embodiments, effectively restricts customers from touching any surface that touches each straw as it is being dispensed. Furthermore, the dispenser presents straws one at a time to the customer in a manner which makes it intuitive to the customer that the straw is being dispensed and how to easily remove it for use by presenting it in an angled upwardly configuration that customers intuitively recognize as only requiring grasping and withdrawal of the straw. In preferred embodiments, a timing circuit provides a delay between removal of one straw and its replacement with another to discourage unnecessary use.

Hitherto, in many cases, soda straws have been dispensed in a sanitary package which does prevent any other customer from touching the straw. Typically, these straws are referred to as "wrapped straws" even though they are more sealed in a sanitary package than wrapped. Wrapping of straws can add up to ten percent or more to the cost paid by the restaurant operator, adding to his costs and cutting significantly into his typically razor-thin margins. Moreover, they also make it easy for customers to take more than one straw, perhaps stockpiling for later use, while providing juveniles with the apparently almost irresistible opportunity to launch the wrappers as missiles against their companions, again leading to not only an incentive to take more straws than are actually needed but also requiring additional labor to police wrappers scattered over the restaurant. Thus, even though supplying of wrapped straws addresses a portion of the sanitation issue, the added cost-in-use strongly discourages their use.

Yingst et al., U.S. Pat. No. 3,519,166 relates to an automated straw dispenser which provides straws projecting outwardly in horizontal disposition from the dispenser. Because Yingst employs a push through channel in which each straw is forced through a dispensing tube by another straw, this dispenser is susceptible to jamming and would be difficult to adapt to dispense upwardly angled straws in a limited volume as push-through dispensing conflicts with gravity feed from a horizontal hopper if the straw must ultimately be angled upwardly.

SUMMARY OF THE INVENTION

The present invention dispenses upwardly angled straws from a gravity-fed dispenser by ejecting each straw over an inclined straw guide having walls shaped to guide the straw as it falls under the force of gravity into a dispensing aperture formed in the face of the dispenser. In this fashion, not only is the possibility of jamming alleviated, by properly shaping the aperture, the straw can be prevented from touching any surface which is accessible to—or touchable by—other customers. If desired, the dispenser can be provided with a dispense delay by which a second straw is not dispensed until a predetermined period after dispensing of the prior straw, thus discouraging unnecessary use of straws.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

FIG. 32 is an isometric of a linear actuator.

FIG. 33 is isometric of a thrust adjusting head.

FIG. 40 is a flow diagram for automatic straw dispenser systems using a traversing head which reciprocates along a shaft to eject straws from a hopper.

DETAILED DESCRIPTION OF THE PREFERRED EMBODIMENT

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 1:
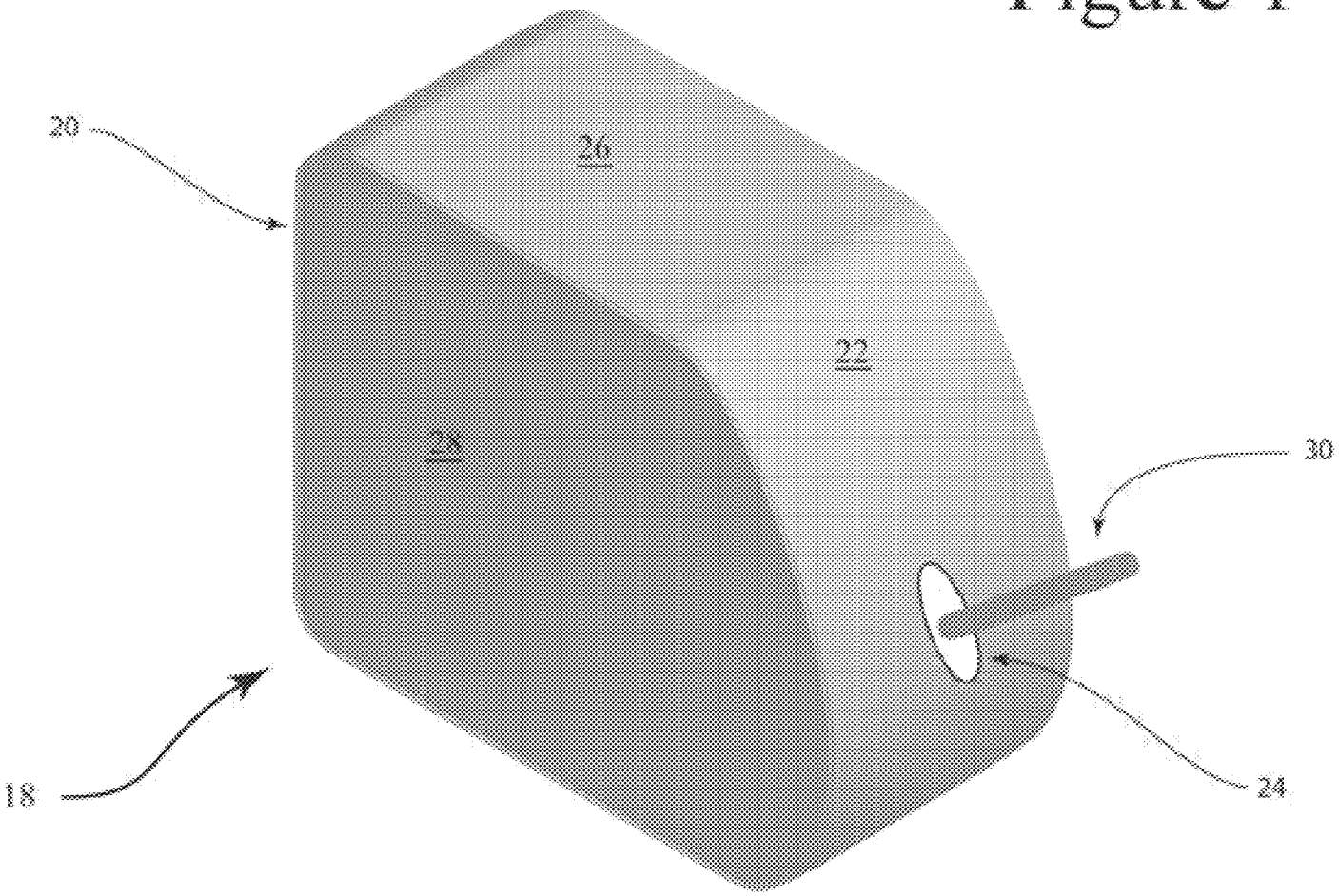
FIG. 1 illustrates a straw dispenser of the present invention with a straw projecting upwardly through a dispensing aperture formed in the anterior housing plate without touching any surface which can be readily touched by customers.
Figure 2:
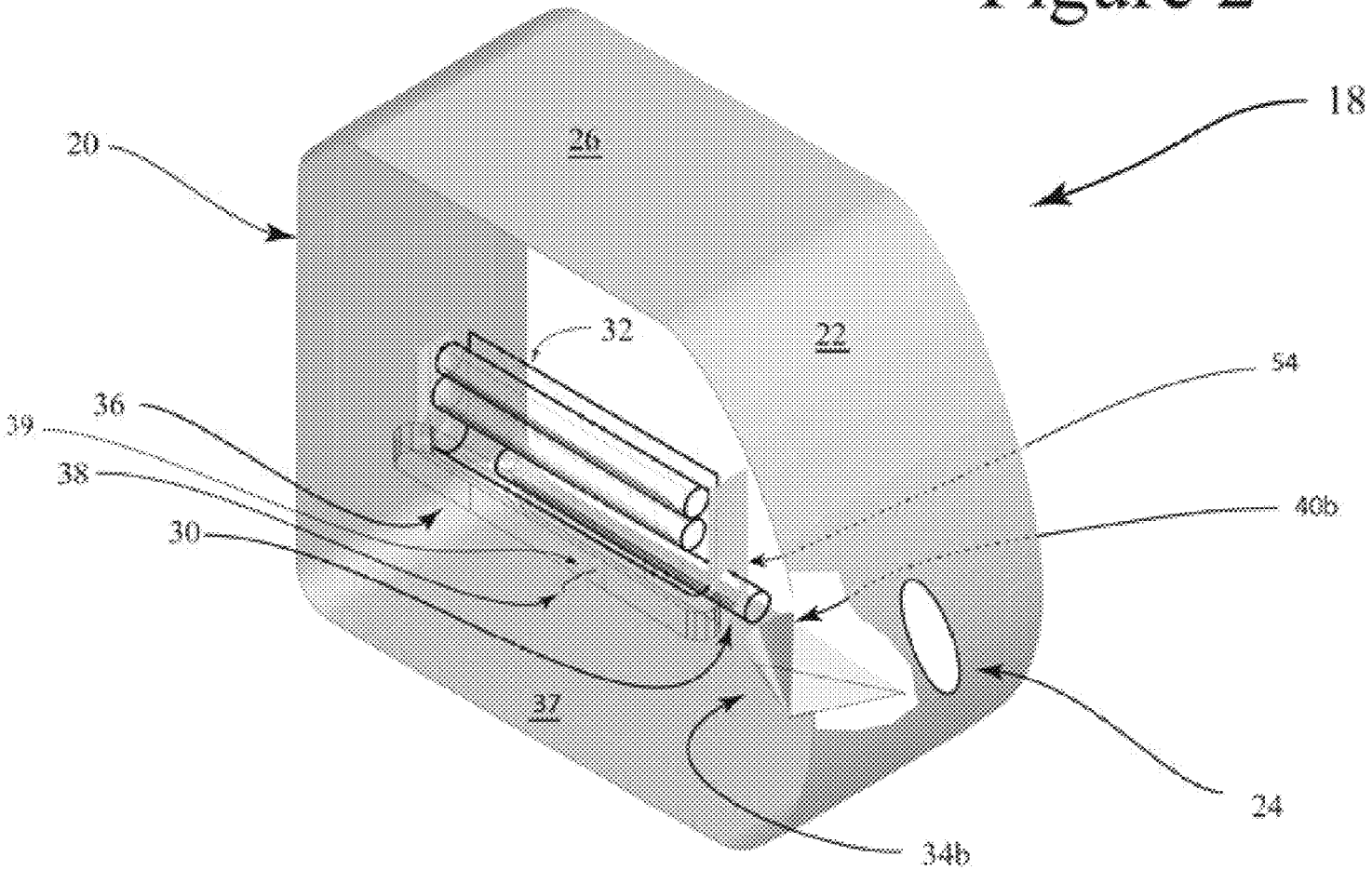
FIG. 2 is a partially cutaway schematic view of a straw dispenser of the present invention with both lateral housing walls removed to illustrate ejection of straws into the straw guide.

Straw dispenser 18 in FIG. 1 comprises housing 20 of any convenient shape, often chosen primarily for marketing and aesthetic considerations to lend a modern or other desired appearance to the dispenser and comport with the overall atmosphere of the target restaurant market. In FIG. 1, straw dispenser 18 is provided with anterior housing plate 22 having dispensing aperture 24 therein. Protection for the interior mechanism is provided by housing top plate 26 and left lateral housing wall 28 and anterior front housing plate 22. As is conventional, housing 20 will of course be provided with floor 37 as shown in FIG. 2 and right lateral housing wall not shown herein. Straw 30 is dispensed though dispensing aperture 24 and projects upwardly therethrough. It has been found that presenting straw 30 projecting upwardly and outwardly from dispenser 20 makes it far more intuitive to customers to remove straws as some have difficulty if straw 30 is presented horizontally. It can be appreciated that even though straw 30 projects through dispensing aperture 24, it does not touch any portion of anterior housing plate 22 and that it is generally quite difficult for customers to contaminate the interior of housing 20. By proper choice of dimensions of dispensing aperture 24, it is possible to discourage or entirely prevent users from touching any portion of automated dispenser 18 which touches straw 30. These features overcome major drawbacks of previously available straw dispensers.

Figure 3:
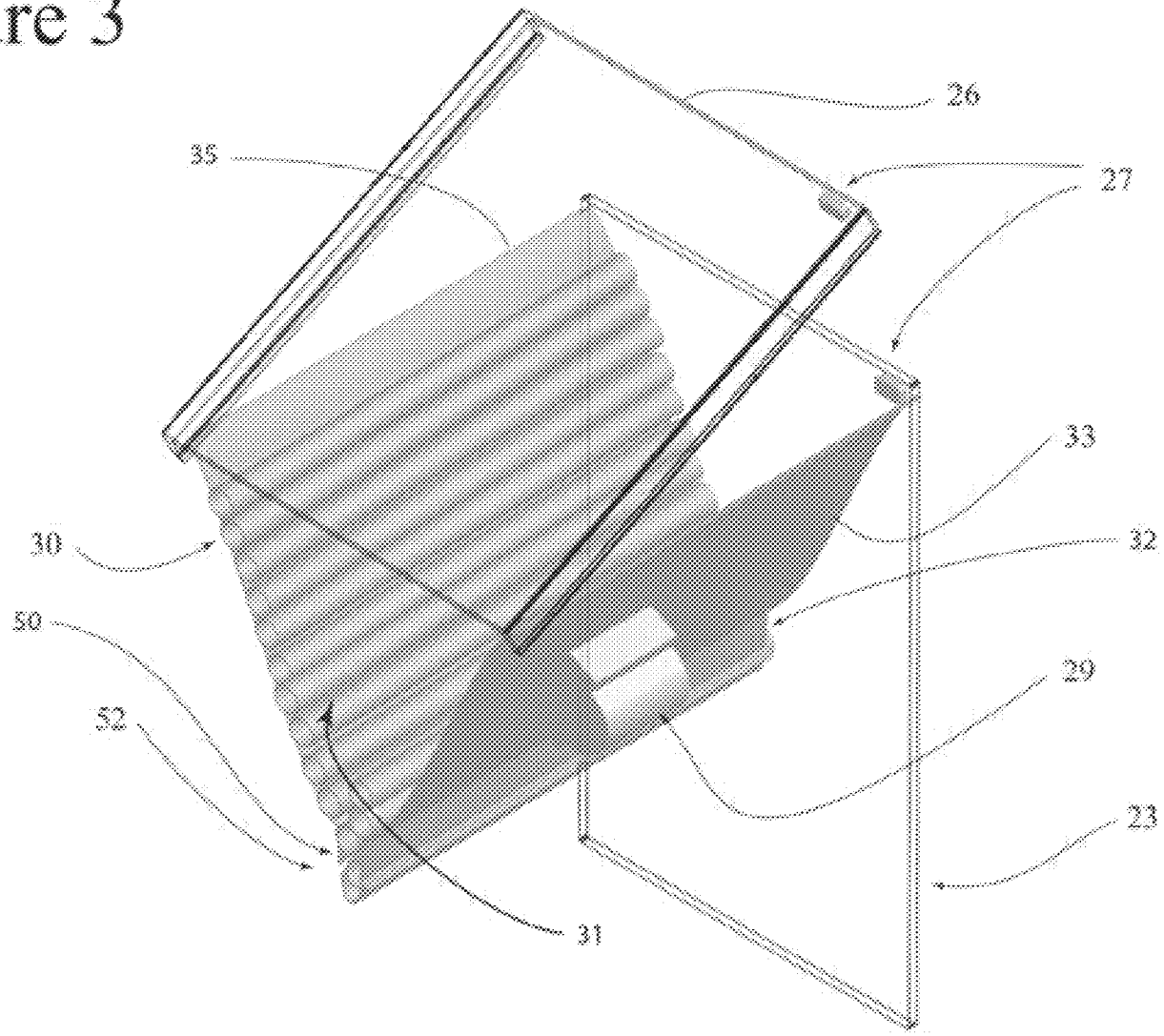
FIG. 3 is a schematic view of the hopper portion of a straw dispenser of the present invention illustrating passage of straws from the hopper into the stacking slot.

FIG. 2 is a cutaway view of dispenser 18, in which the principal components of the straw ejection system are depicted while FIG. 3 illustrates hopper 31 in which straws 30 are stored above the mechanism illustrated in FIG. 2 prior to dispensing. In FIG. 2, straws 30 to be dispensed are stacked vertically one above another adjacent vertically extending right stacking slot lateral wall 32 prior to being ejected seriatim into straw guide 34*b* which positions straws 30 projecting through dispensing aperture 24 by action of gravity. Motive force for ejection of straws is conveniently provided by drive paddles 38 connected to endless translating drive belt 36 by drive paddle necks 39 projecting laterally therefrom. It is considered quite advantageous for drive belt 36 to be disposed such that it translates in vertical planes as shown in FIG. 2 as this limits interference with straw guide 34*b* and makes it possible to devote more of the interior volume of straw dispenser 18 to straw storage while reducing the overall height thereof. In particular, since hopper 31 defines a generally converging shape which is narrow at its lowest extremity and broadens upwardly, the space beneath either side of hopper 31 conveniently accommodates the upwardly opening drive belt 36. In one sense, the surface of drive belt 36 can be considered mathematically to be a generalized cylinder wherein the generators of the cylinder extend generally vertically.

In FIG. 3, hopper 31 for storing straws 30 prior to dispensation is defined forwardly of posterior housing plate 23 between inclined right hopper wall 33 adjoining right stacking slot vertical wall 32 and inclined left hopper wall 35 adjoining vertically extending left stacking slot lateral wall 50. Access slot 52 is defined between left stacking slot vertical wall 50 and right stacking slot vertical wall 32 so that drive paddles 38 may be connected to drive belt 36 by drive paddle necks 39 extending therethrough. Conveniently, the lower extremity of right stacking slot vertical wall 32 presents a "J" shaped cross-section upon which straws 30 are supported prior to ejection from between stacking slot vertical walls 32 and 50. Preferably, to aid in filling of hopper 31 by tilting of housing top plate 26, the longitudinal dimension of hopper 31 is somewhat in excess of the length of straws 30 to be dispensed therefrom; but the maximum horizontal transverse dimension is less than the length of straws 30 to discourage straws 30 from lying with their longitudinal axes transverse to the width of hopper 31. Upon closing of housing top plate 26, lid close proximity sensors 27 are operatively connected to controller 70 (FIGS. 11 and 25) which activates hopper vibrator 29 for a short period thereafter to allow straws 30 to rearrange themselves into a configuration in which the axes thereof are oriented parallel both to each other and to the longitudinal axis of hopper 31 presenting a compact downwardly flowing disposition relative to each other for eased dispensation. Preferably, top plate 26 is bowed upwardly to present a hollow cavity above hopper 31 and limit or discourage jamming of an excessive number of straws 30 into hopper 31 which might lead to jamming.

Figures 4, 5, 6:
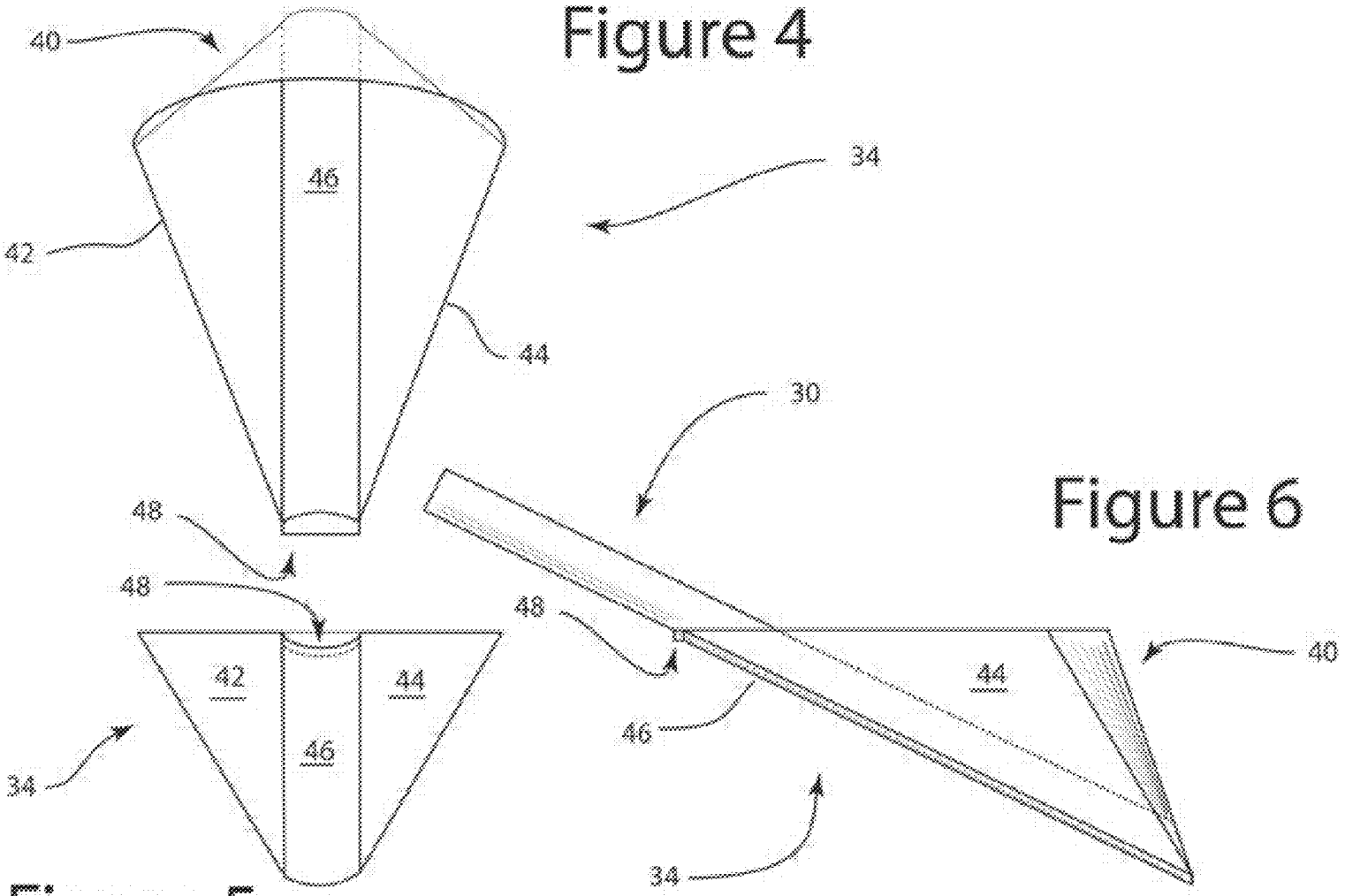
FIGS. 4-6 illustrate a preferred configuration for the straw guide used in the present invention.
Figures 7, 8, 9, 10:
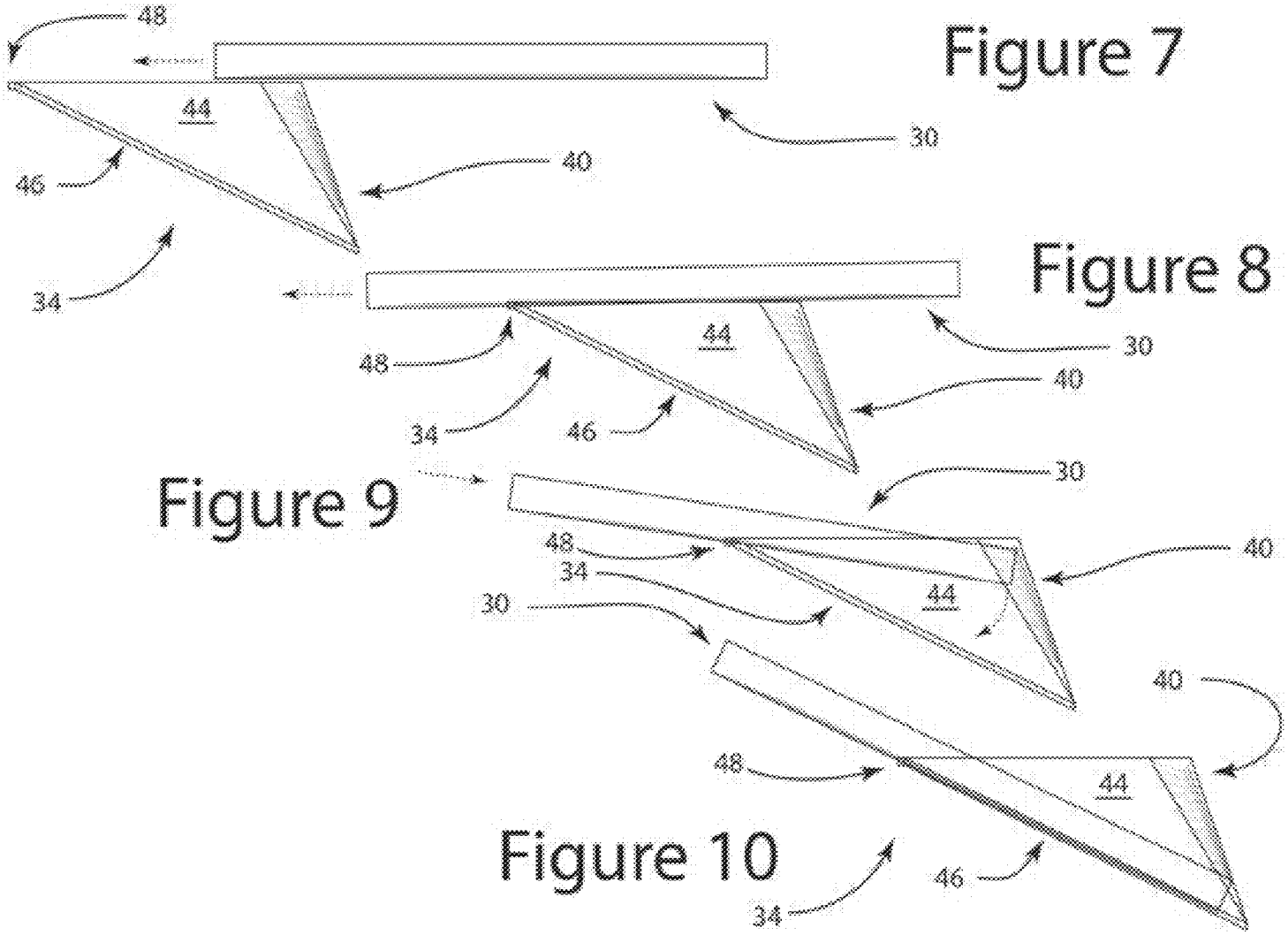
FIGS. 7-10 illustrate how a straw horizontally ejected from the straw ejection slot is reoriented by action of gravity into an upwardly inclined orientation in the straw guide.
Figures 18, 19, 20:
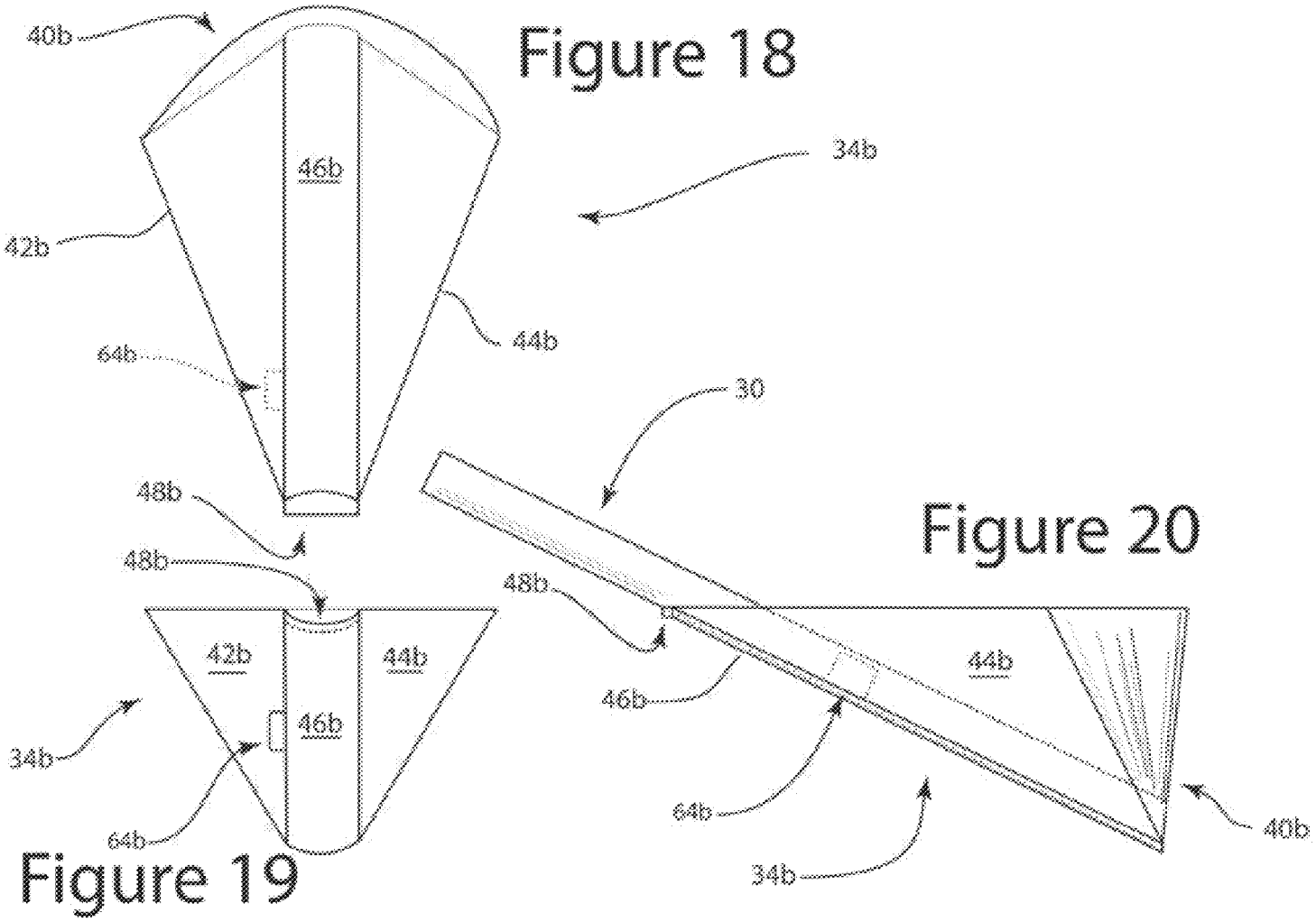
FIGS. 18-20 illustrate another preferred configuration for the straw guide used in the present invention having a generally declivitous posterior wall.
Figure 21:
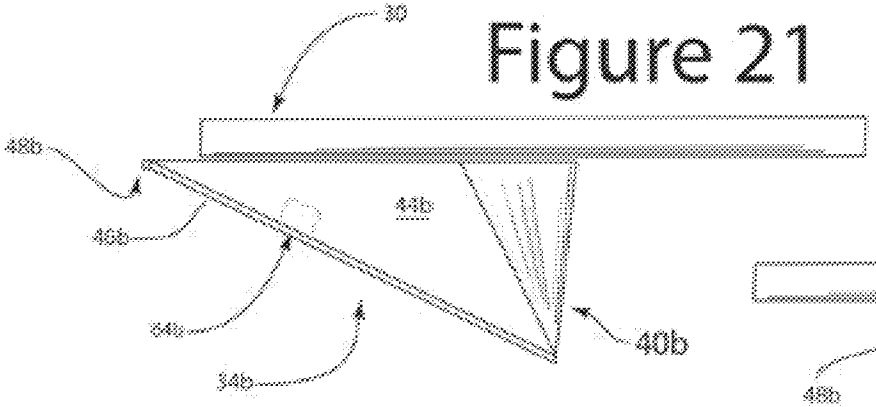
FIGS. 21-24 illustrate how a straw horizontally ejected from the straw ejection slot is reoriented by action of gravity into an upwardly inclined orientation in the alternative straw guide having a generally vertical posterior wall.
Figure 22:
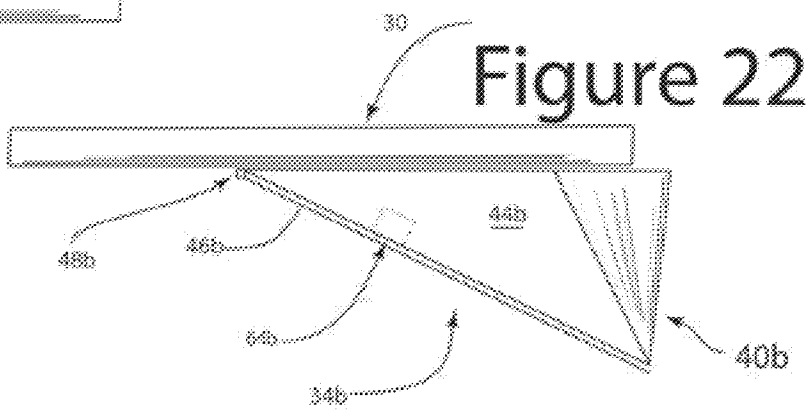
Figure 23:
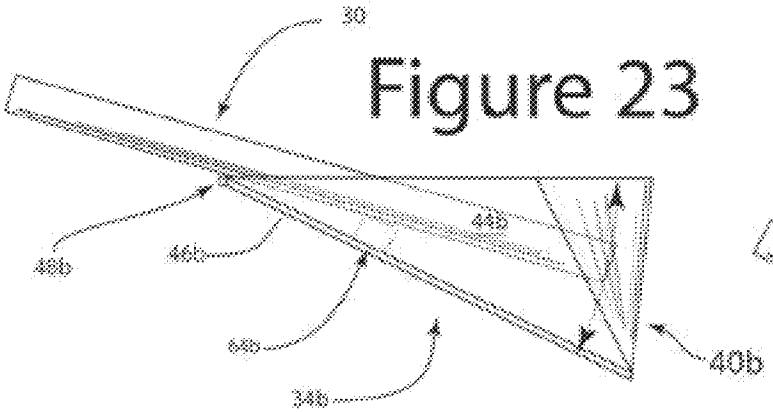
Figure 24:
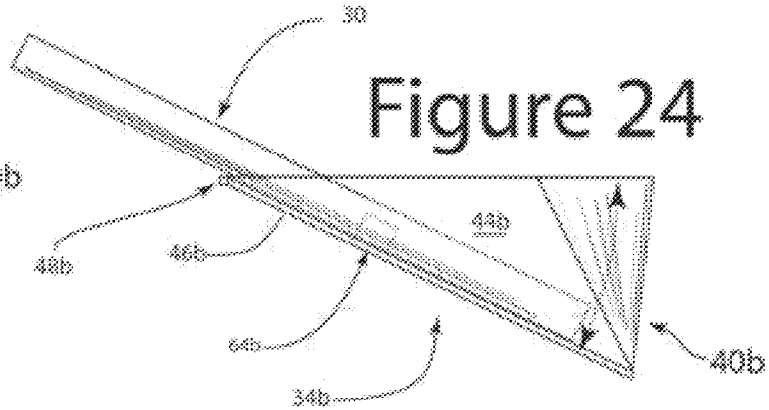

In FIG. 2, straw guide 34*b* is depicted having a declivitous forwardly sloping rear wall 40*b* as detailed in FIGS. 18-20. FIGS. 4 through 6 illustrate an alternative straw guide 34 having a relieved rear wall 40 which obviates the possibility of straw 30 becoming lodged there against as it falls into the dispensing position as illustrated in FIGS. 7 through 10. In FIGS. 4 through 6, inclined left lateral guide wall 42 cooperates with inclined right lateral guide wall 44 to urge straw 30 into centrally located straw retention trough 46 with the midpoint of straw 30 located inwardly and posteriorly to straw retention ledge 48 which as illustrated in FIGS. 7 through 10 serves as a pivot point upon which straw 30 reorients itself upon clearing relieved rear guide wall 40 to fall into an upwardly and outwardly projecting disposition to be ready for dispensation through dispensing aperture 24.

Figure 11:
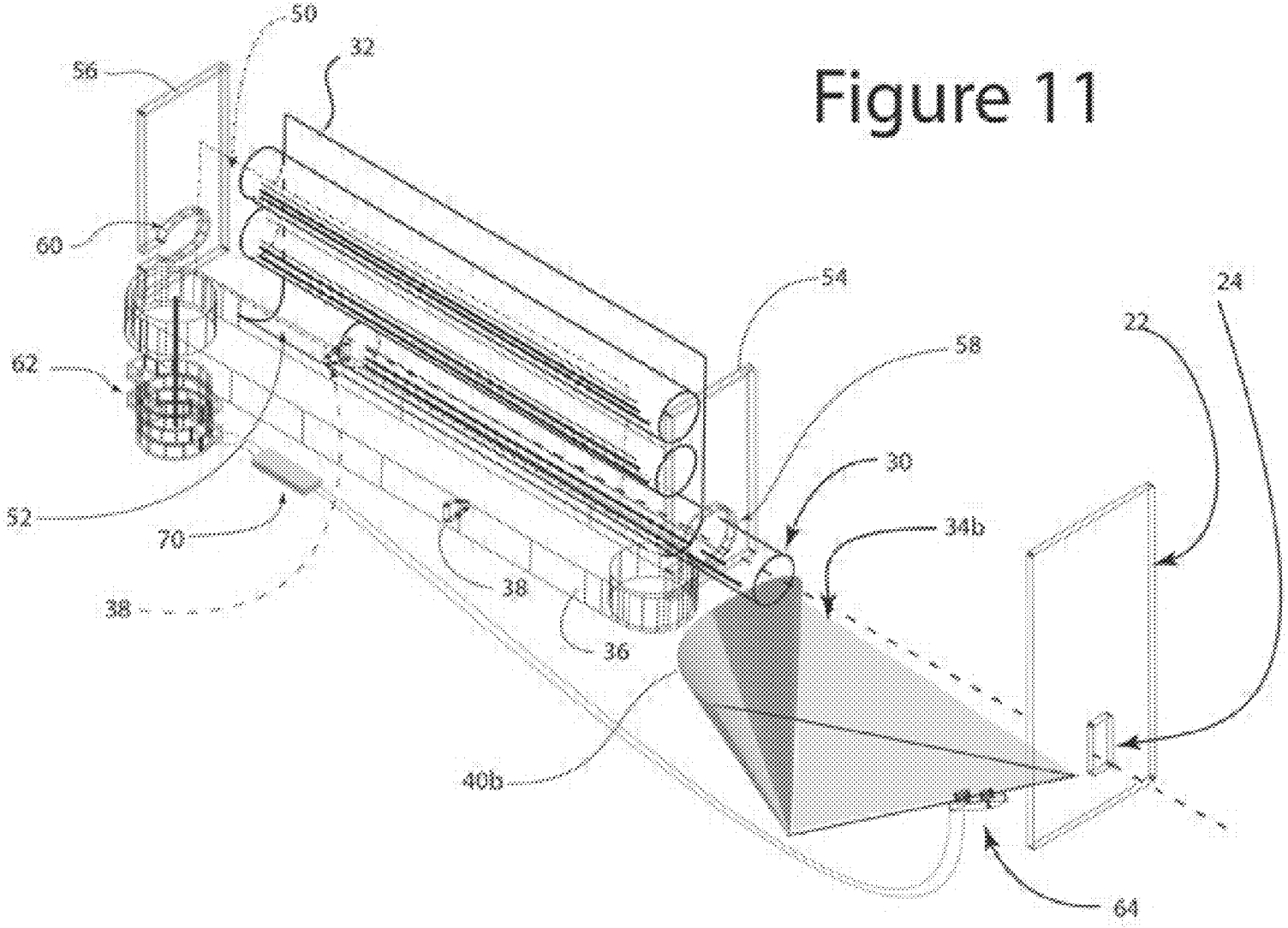
FIG. 11 is a partially exploded view illustrating the mechanism for ejection of straws into the straw guide.
Figure 14:
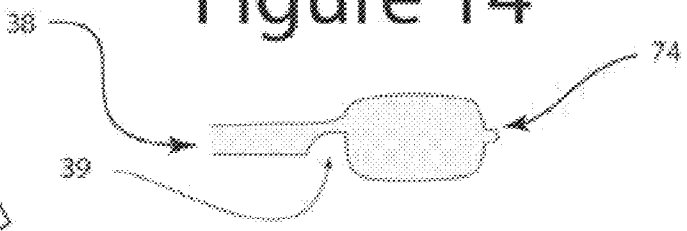
FIGS. 13 and 14 illustrate details of the drive paddle which ejects the straw from the straw ejection slot into the straw guide.
Figure 13:
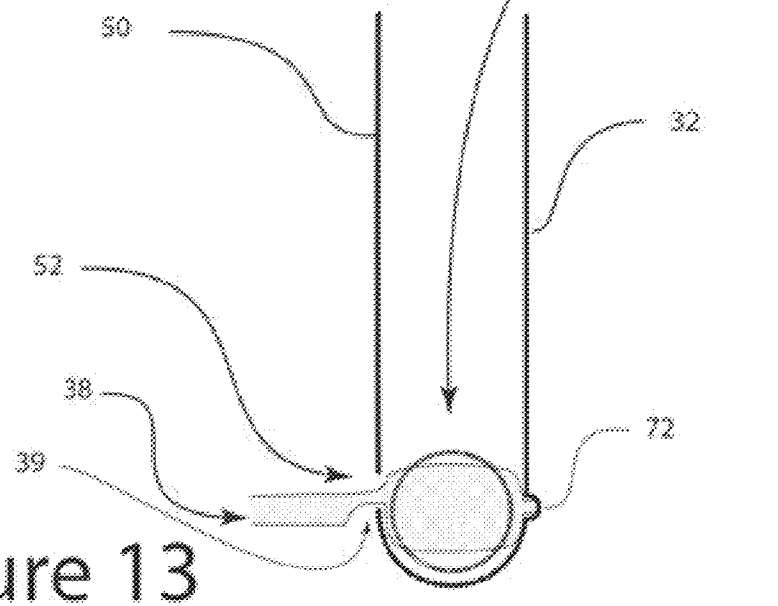

FIGS. 11 through 14 further illustrate details of the mechanism by which straws 30 are ejected from between right stacking slot lateral wall 32 and left stacking slot lateral wall 50 (shown in phantom in FIG. 11). Longitudinal motion of straws 30 between stacking slot vertical walls 32 and 50 is restrained by stacking slot anterior vertical wall 54 and stacking slot posterior wall 56, while straws 30 are ejected through ejection opening 58 in stacking slot anterior vertical wall 54. As drive belt 36 translates, necks 39 of drive paddles 38 progressively pass through access opening 60 in stacking slot posterior wall 56, access slot 52 (shown more clearly in FIGS. 13 and 14) and ejection opening 58 through stacking slot anterior wall 54, yet straws 30 are confined to pass only through ejection opening 58 in stacking slot anterior wall 54. Drive paddles 38 preferably have extension guide tabs 74 formed thereupon riding in extension guide groove 72 in right stacking slot lateral wall 32 ensuring that drive paddles 38 cannot be lodged into the rear opening of straws 30 as each is propelled forwardly though ejection opening 58 by pressure from drive paddle 38.

Figure 12:
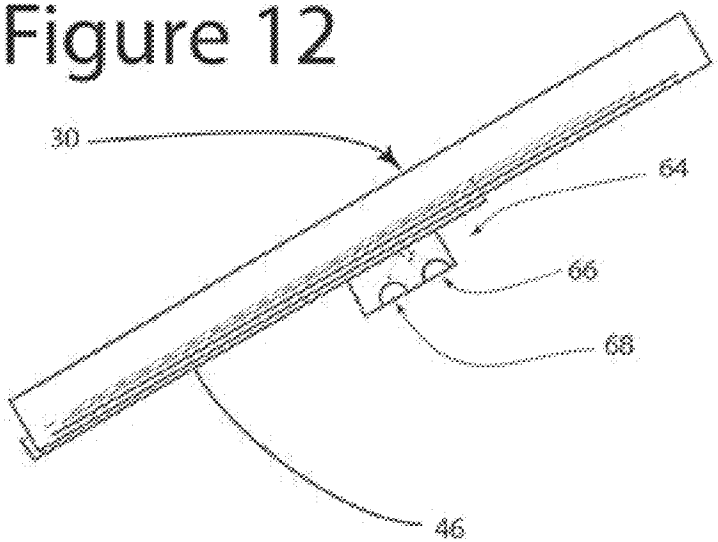
FIG. 12 illustrates a straw detector usable to detect the presence or absence of a straw in the straw guide.
Figures 15, 16, 17:
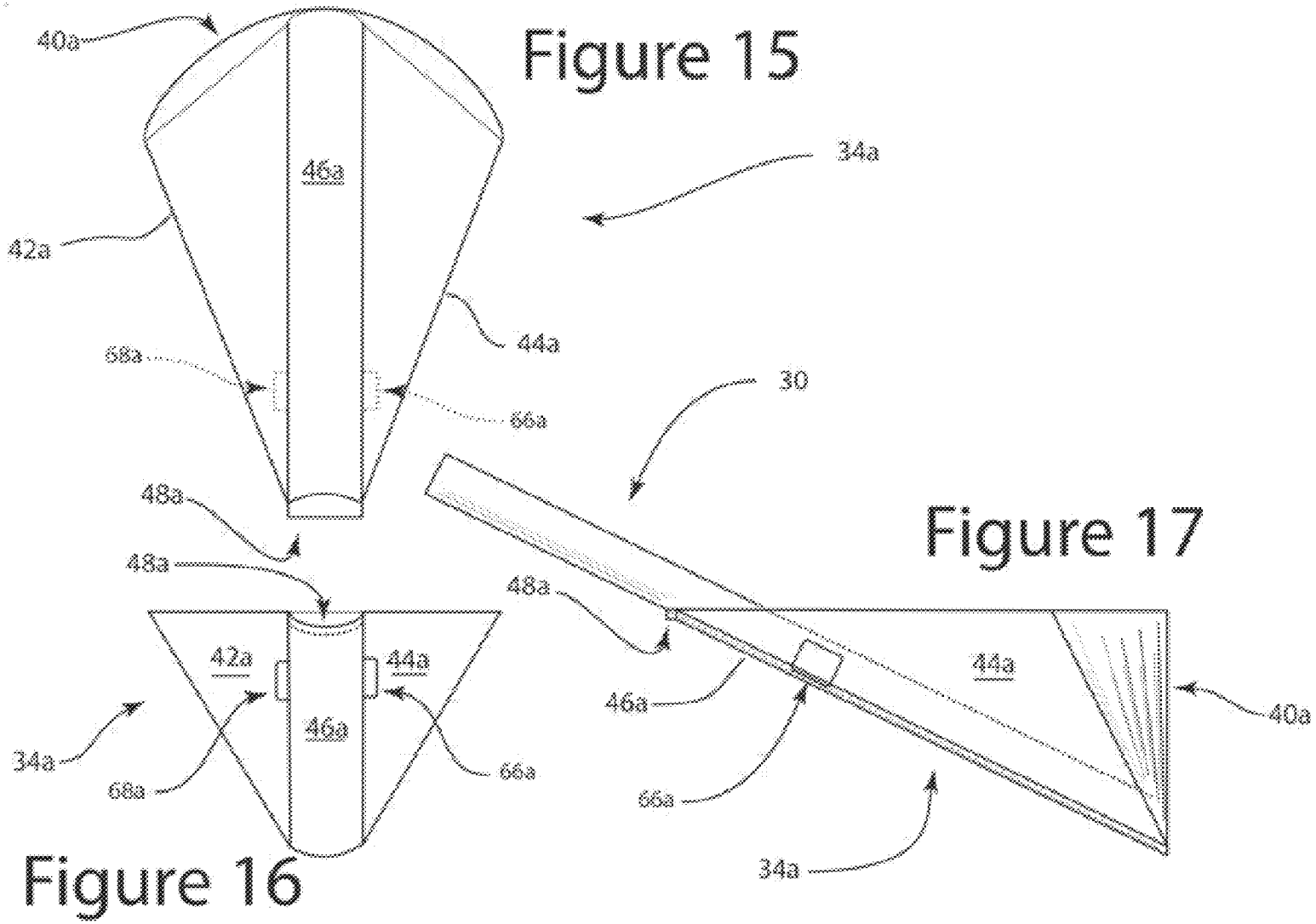
FIGS. 15-17 illustrate another preferred configuration for the straw guide used in the present invention having a generally vertical posterior wall.
Figure 25:
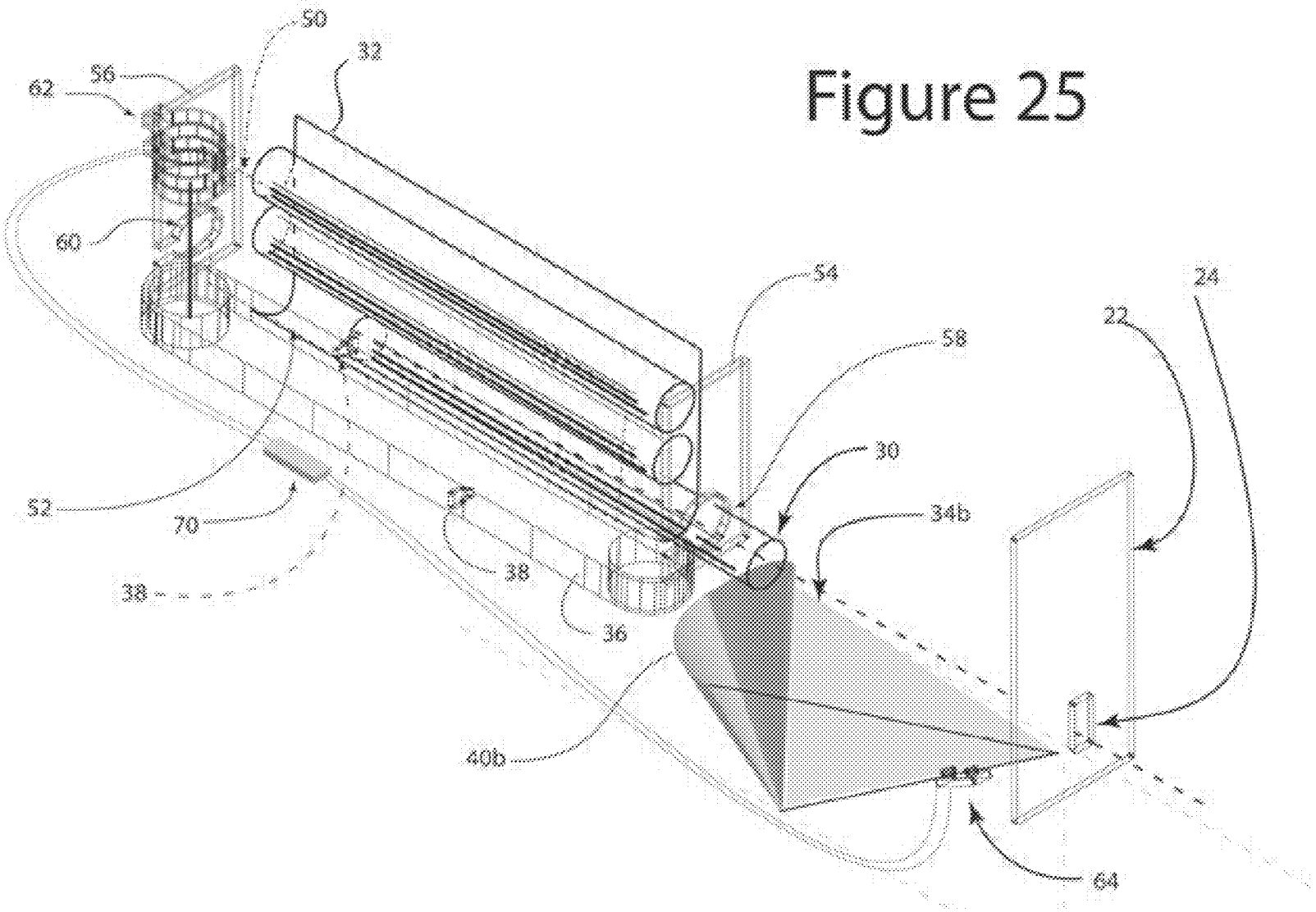
FIG. 25 illustrates a mechanism for ejection of the straw into the straw guide in which the motor is placed above the drive belt.

When straw 30 is removed through dispensing aperture 24, its absence or presence may be detected by either a transmissive or reflective light detection sensor. In FIG. 11, reflective light detection sensor 64 is illustrated, in which as shown in FIG. 12, detects the absence of reflected light from LED light source 66 and, working through controller 70, photoreceptor 68 activates motor 62 driving drive belt 36 and drive paddles 38 for either a predetermined drive time or until straw 30 is ejected into guide tray 34 with the presence of reflected light being again detected inactivates motor 62 until currently presented straw 30 is removed triggering another cycle. In the event that excessive time passes between detection of absence of a straw 30 in guide tray 34 and movement of another straw 30 into dispensing position, hopper vibrator 29 is temporarily activated to reorient straws 30 disposed in hopper 31, allowing a straw 30 to fall into ejection position and thereafter be ejected into guide tray 34 when motor 62 is reactivated. If after an appropriate number of cycles, no straw has been delivered into ejection position, cycling is interrupted and an audible or visual signal (not shown) is activated to alert restaurant staff that attention is required to refill hopper 31. As mentioned above, hopper 31 has inwardly sloping smooth walls with dimensions being chosen to urge straws 30 within hopper 31 to align themselves by action of gravity into a configuration in which the longitudinal axes of all straws 30 are parallel to one another to restrict attention to the dispenser being required except in situations in which hopper 31 must be refilled. Preferably, the presence or absence of straw 30 in dispensing trough 46 is detected by detectors having no moving parts to increase the reliability of the overall system. A more preferred sensor configuration is shown in FIGS. 15 through 17 in which drive motor 62 is activated by the presence of a light signal from source 66*a* being received by light detector 68*a* as is occasioned by absence of straw 30 in straw retention trough 46. As sensor 68*a* and source 66*a* are vertically disposed on either lateral side of straw retention trough 46, the possibility of occlusion by dusting or other debris is reduced. In FIGS. 15 through 17, guide tray 34*a* having generally vertical rear wall 40*a* is depicted, structures analogous to those shown in FIGS. 4-10 bearing similar numbers with a suffix "a" appended thereto, i.e. 42*a*, 44*a*, 46*a* and 48*a*. So long as straw 30 is advanced beyond rear wall 40*a* during the drive portion of the cycle, provision of a generally vertical rear wall 40*a* for straw guide 34*a* is entirely satisfactory. As shown in FIGS. 2, 11 and 25, use of upwardly opening drive belt 36 in the form of a generalized cylinder having generally vertical generators makes it possible to easily locate drive belt 36 horizontally adjacent to access slot 52 which serves to eject straws 30 into dispensation position without interference between drive belt 36 and straw guide 34. In FIGS. 18 through 20, straw guide 34*b* is depicted having forwardly inclined declivitous rear wall 40*b*. As before, use of vertically opening drive belt 36 makes it easy to avoid interference between the straw ejection mechanism and straw guide 34*b* while enabling straw hopper 31 to be located closely adjacent to anterior housing plate 22, less than one straw length away, and reduces the height of the dispensing portion of the dispenser. In preferred embodiments, straw hopper 31 is located closely adjacent to anterior housing plate 22 being less than three quarters of a straw length away, more preferably just slightly over half a straw length away. In preferred embodiments, straw hopper 31 is located closely adjacent to anterior housing plate 22 being less than three quarters of a straw length away, more preferably just slightly over half a straw length away.

FIGS. 21 through 24 illustrate how straw 30 is guided into straw retention trough 46*b* by action of gravity once rear edge of straw 30 is urged past rear wall 40*b* with the center of gravity of straw 30 being located posteriorly with respect to straw retention ledge 48*b* allowing straw 30 to pivot downwardly against inclined left lateral guide wall 42*b* which cooperates with inclined right lateral guide wall 44*b* to urge straw 30 into centrally located straw retention trough 46*b* with the midpoint of straw 30 located inwardly and posteriorly to straw retention ledge 48. In FIGS. 21 through 24, reflected light sensor 64*b* combines both a light source, conveniently an LED, and a receiver that detects the absence of light reflected from straw 30 alerting controller 70 to impel another straw 30 into dispensation position resting in straw retention trough 46*b* in guide tray 34*b*. As sensor 64*b* is located horizontally adjacent to straw 30, a vertical aspect is presented reducing possibility of occlusion by dusting or the like.

FIG. 25 illustrates an alternative internal configuration for automated dispenser 18 in which drive motor 62 is placed above drive belt 36.

Figure 26:
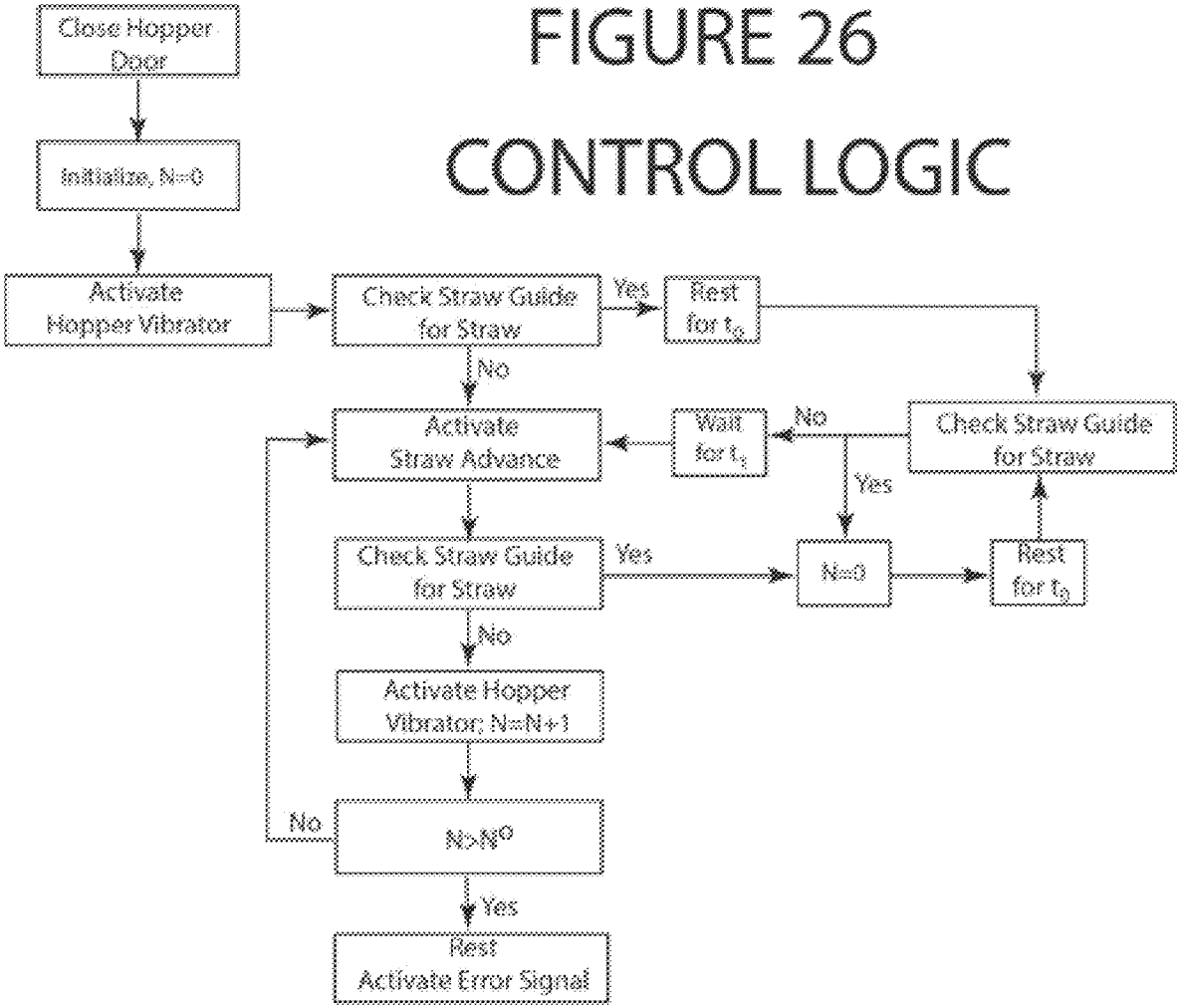
FIG. 26 is a logic flow diagram of an automated straw dispenser in which the system checks for a straw in the straw guide every $t_o$ seconds and provides a delay of $t_i$ seconds for dispensing of a second straw after the first has been removed.

FIG. 26 is a logic flow diagram for controller 70 illustrating its programming to control operation of belt drive motor 62 and hopper vibrator 29 in response to inputs from door close detection switches 27 and straw sensor 64. Conveniently, controller 70 can be programmed to check for the presence of straw 30 in position for dispensation periodically, every $t_0$, where $t_0$ is a conveniently small fraction of a second and to operate hopper vibrator 29 for a suitable period of time to facilitate rearrangement of straws 30 in hopper 31 so that the axes thereof are parallel to each other but to shut off and provide an attention signal if movement of a straw 30 into dispensation position has not been triggered after a suitable number of attempts.

Figure 27:
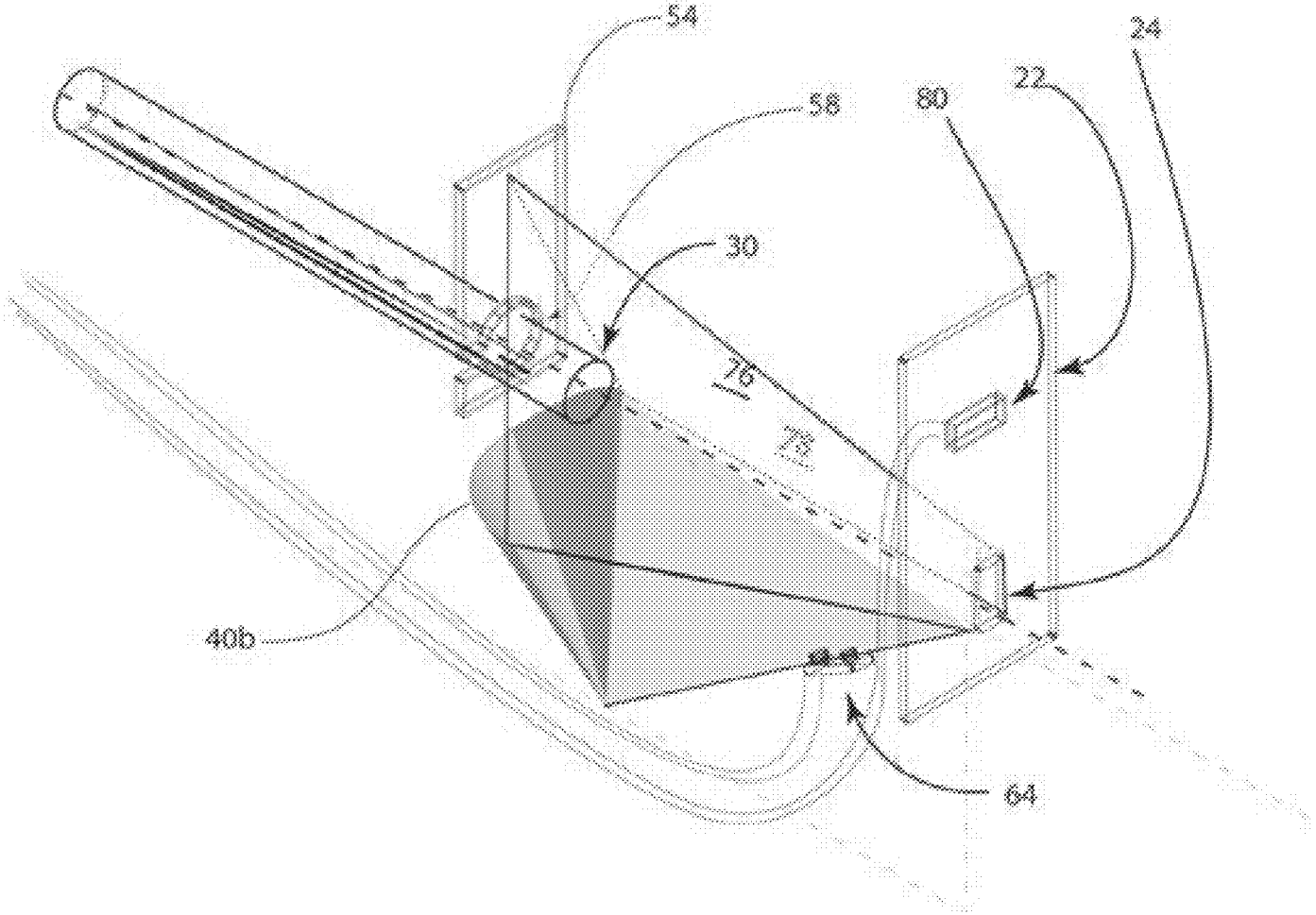
FIG. 27 is an alternate view, similar to a portion of FIG. 11, illustrating a pair of plates forming a tent-like shield over the straw guide to ensure that straws ejected from the stacking slot find their way into the straw guide.

FIG. 27 illustrates an alternative internal configuration for automated dispenser 18 in which plates 76 and 78 (with 78 being shown in phantom) above guide tray 34 ensure that straws ejected find their way into dispensing aperture 24 by forming a chute to guide ejected straws into dispensing aperture 24 and prevent them from being displaced laterally or vertically from the path leading from ejection opening 58 through stacking slot anterior wall 54. In FIG. 27, there is also pictured a non-contact sensing mechanism 80 which initiates the "Activate Straw Advance" protocol shown in FIG. 26 only if a hand is waved in front of dispenser 18. Such non-contact sensing mechanisms are well known as discussed in U.S. Pat. No. 8,186,551 B2, Morris, et al. presenting a very thorough review of known non-contact sensing mechanisms. Known mechanisms can be quite energy efficient allowing for power by hardwiring or from batteries.

Figure 28:
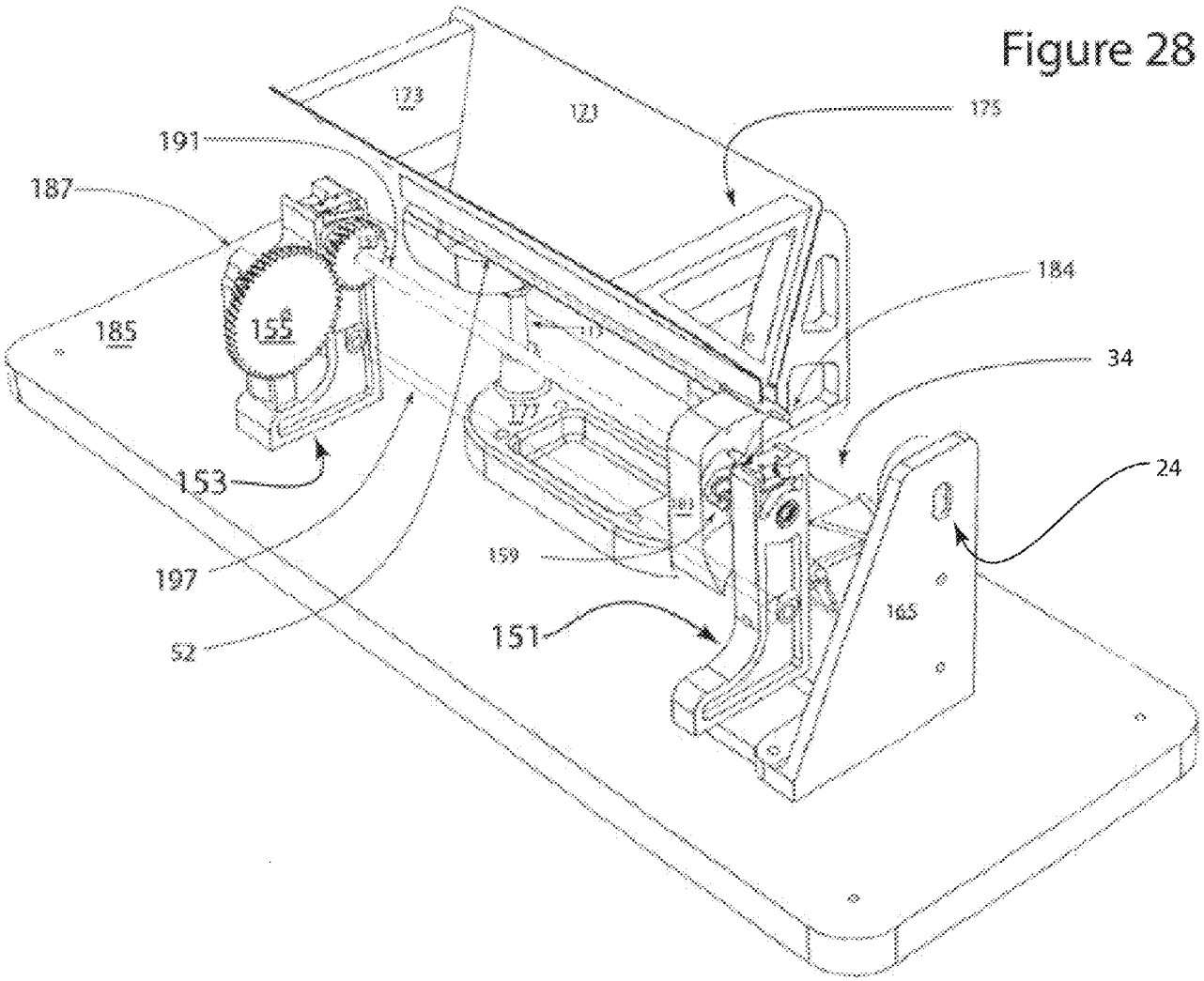
FIG. 28 is a three quarter schematic view of the interior mechanism of another straw dispenser of the present invention.
Figure 29:
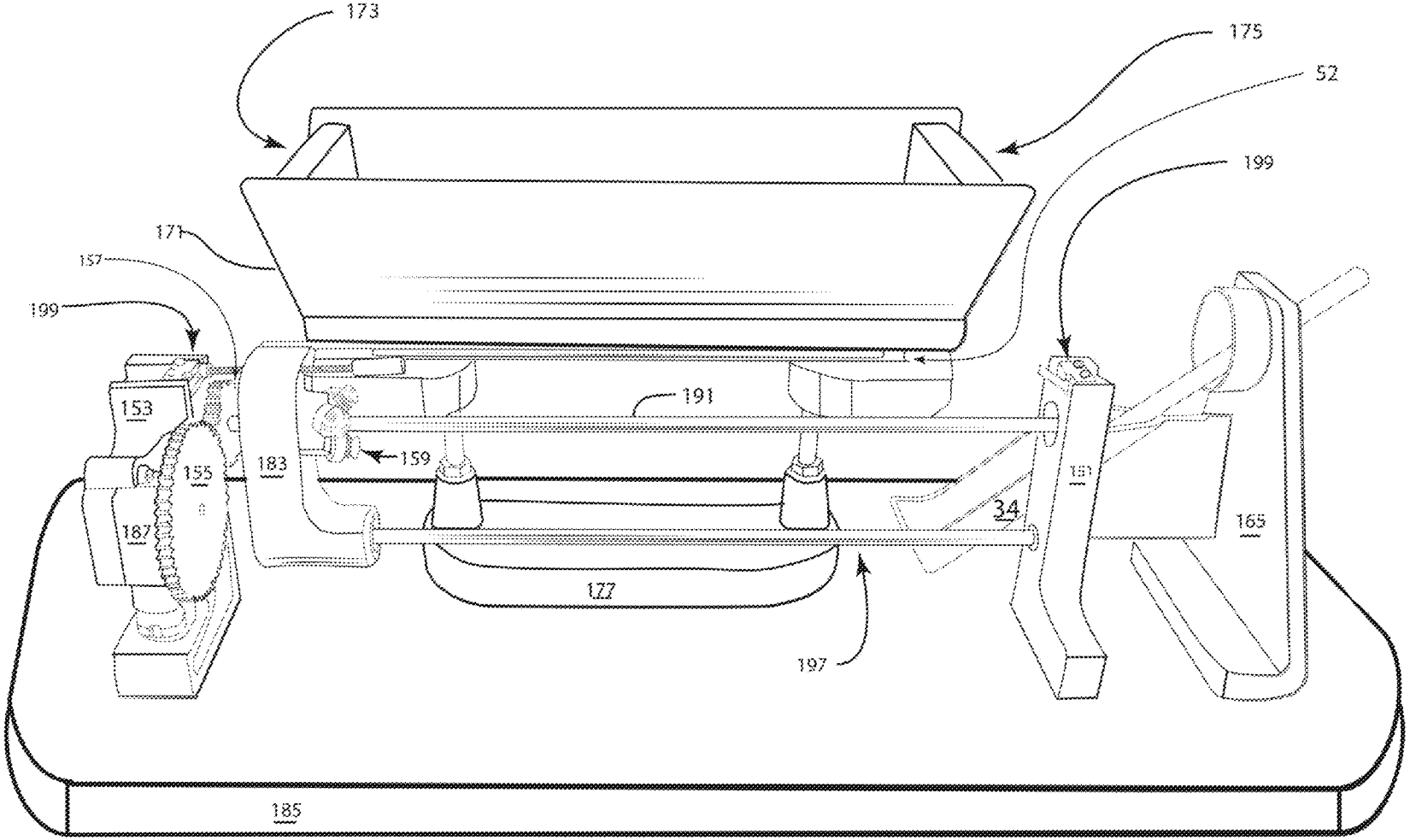
FIG. 29 is side schematic view of the interior mechanism of another straw dispenser of the present invention.

FIGS. 28 and 29 illustrate the interior mechanism of another straw dispenser of the present invention differing from those embodiments previously disclosed in that a threadless linear actuator 61 encompassed within, and therefore not visible, traversing head 183 disposed on rotable shaft 191 is used to advance ejection rod 184 carried on a reciprocating traversing head 183. A typical linear actuator 61 is illustrated in FIG. 32. Such threadless linear actuators are well known items of commerce and are described in U.S. Pat. No. 3,272,021; U.S. Pat. No. 3,425,284; U.S. Pat. No. 4,191,059; U.S. Pat. No. 4,224,831; U.S. Pat. No. 4,726,242;

U.S. Pat. No. 4,411,166. In brief, these linear actuators employ skewed roller members arranged about and engaging a drive shaft to translate rotation of the drive shaft to linear displacement along the shaft. One particular brand of linear actuators is sold under the trademark ROH'LIX by ZERO-MAX, Inc., 13200 Sixth Avenue North, Plymouth, Minn. 55441. In FIGS. 28 and 29, hopper 171 is configured similarly to the hopper in previous embodiments so that a J-shaped ledge is formed at the bottom of the right wall of hopper 32 to retain the lowermost straw 30 thereupon while ejection rod 184 carried on traversing head 183 protrudes into access slot 52. As shown in FIGS. 34-39, ejection rod 184 riding in engagement slot 52 has considerable length so that as straw 30 is ejected, straw 30 above it is still supported by ejection rod 184 and so does not move into ejection position until after traversing head 183 has activated forward limit switch 199, which signals the controller to reverse motor module 187 reversing the direction of rotation of shaft 191 so that traversing head 183 is returned to its rest position engaging rear limit switch 199.

Figure 30:
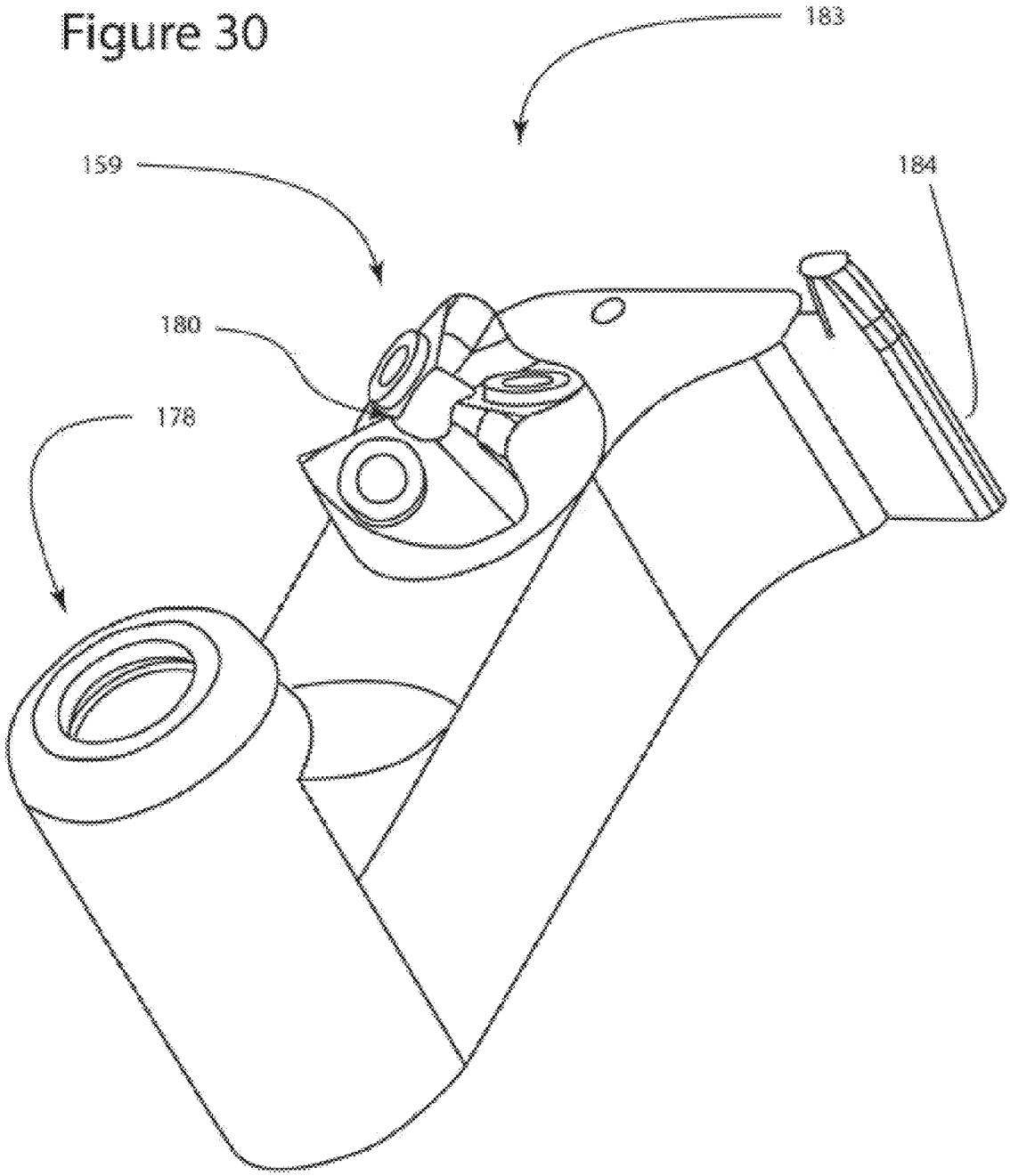
FIG. 30 is an isometric perspective of a traversing head.

FIG. 30 illustrates traversing head 183 having thrust adjustment head 159 surrounding rotary traversing rod aperture 180 through which rotary traversing rod 191 passes. In some embodiments, auxiliary support rod 197 passing through support aperture 178 may be employed to support the weight of traversing head 183. In many cases, the weight of traversing head 183 will be sufficiently low that auxiliary support rod 197 may be dispensed with. Ejection rod 184 traverses the length of engagement slot 52 as traversing head 183 traverses along rotary traversing rod 191. Significantly ejection rod 184 is of significant length so that as discussed above, when straw 30 is being ejected, straws above cannot fall into dispensing position until lowermost straw 30 has been ejected and traversing head 183 has retraced its path and cleared the posterior end of engagement slot 52.

Figure 31:
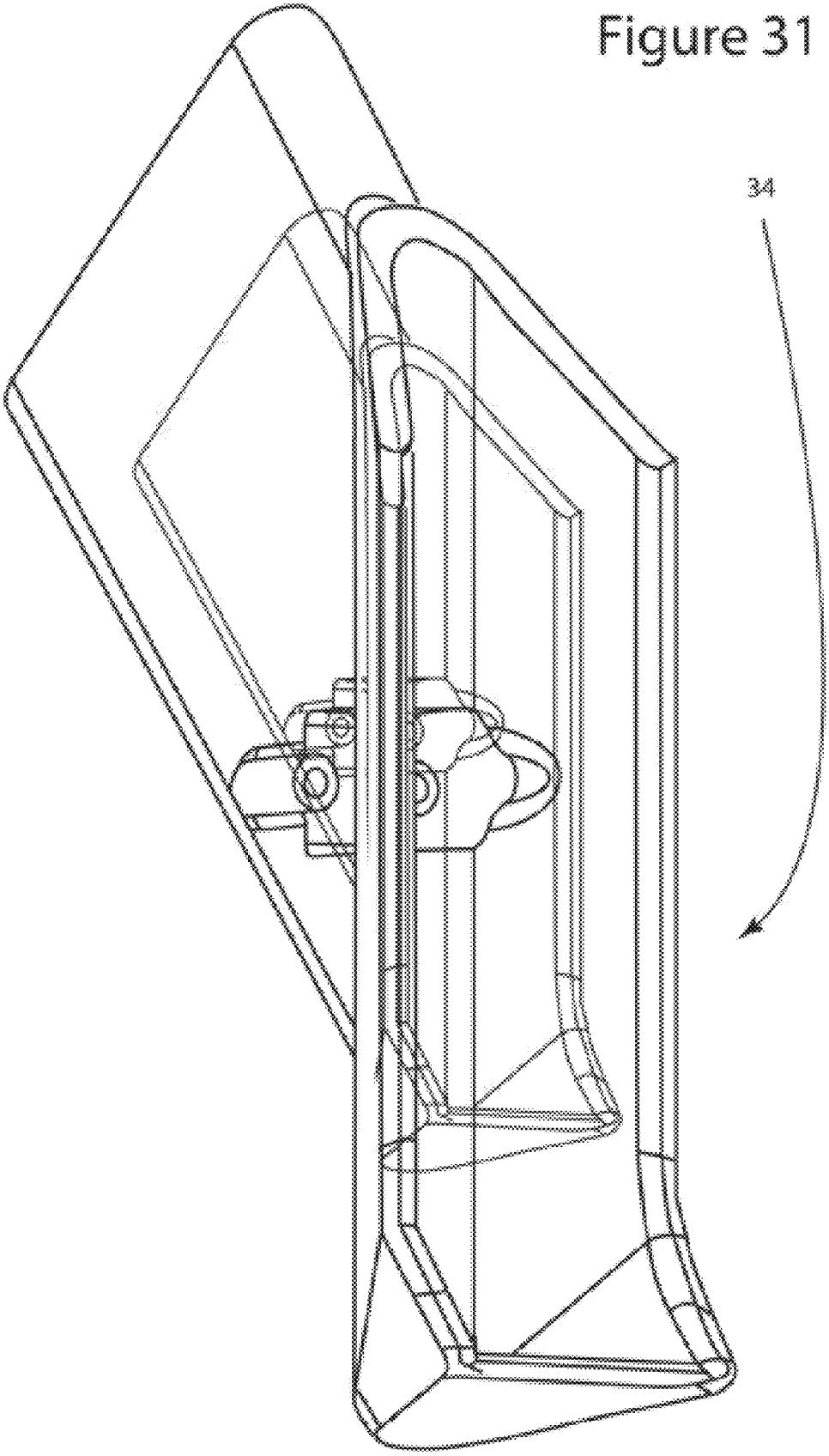
FIG. 31 is an isometric of a receiving tray.

FIG. 31 illustrates yet another design for a guide tray 34 to receive and properly orient straws 30 after ejection from hopper 31. Significantly, in the design depicted in FIGS. 28 and 29, straws 30 penetrate dispensing aperture 24 while being ejected from hopper 31 and the rear ends of straws 30 fall backward into guide tray 34 only after the straw is ejected from hopper 31.

FIG. 33 illustrates a known thrust adjusting head 159 usable to adjust the force with which conventional linear actuator 61 shown in FIG. 32 engages rotary drive shaft 191.

Figure 34:
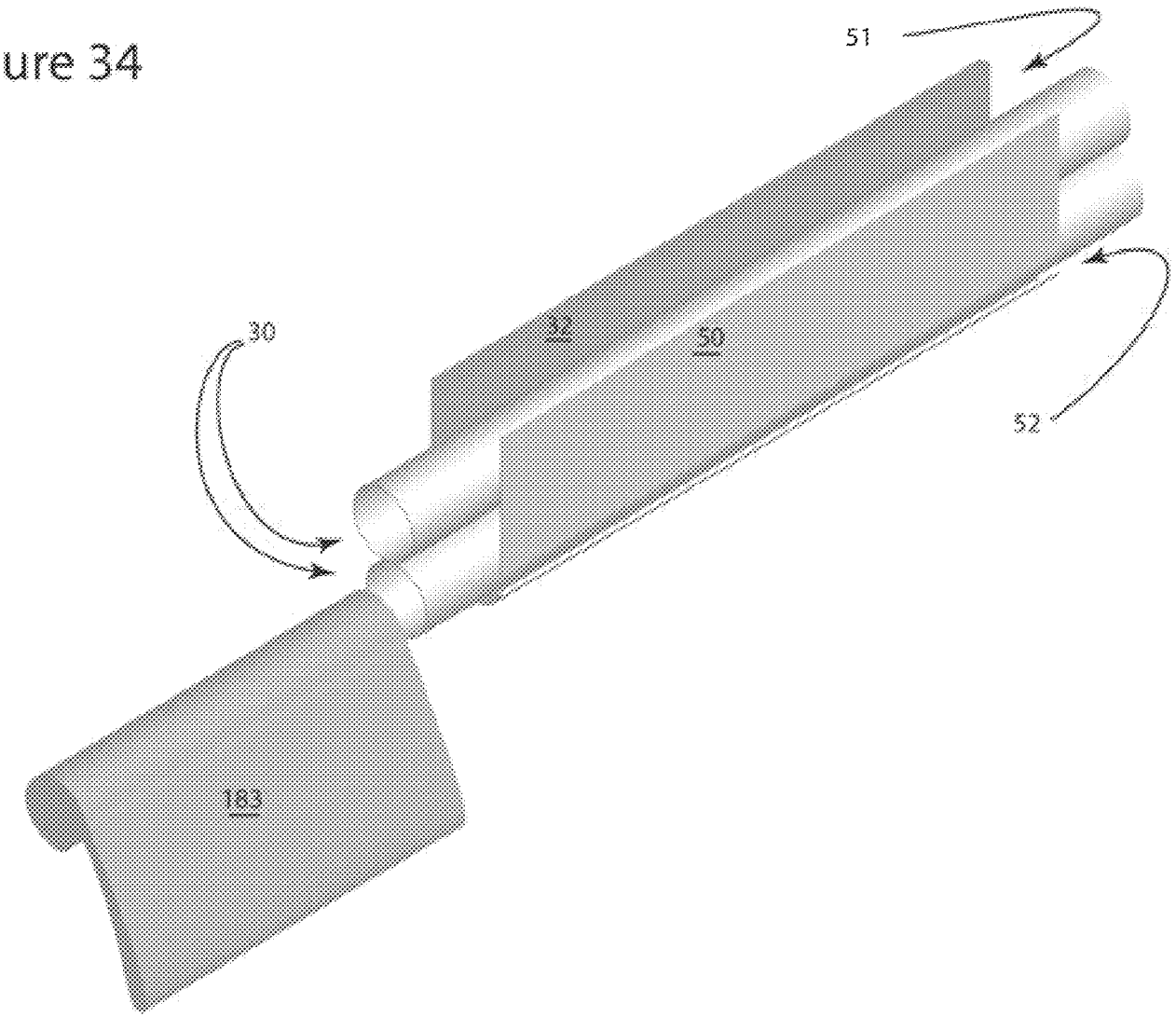
FIGS. 34-39 are schematic isometric perspective illustrating the straw dispensing operation when a linear actuator is used to propel the translating head along a rotating rod. In particular this sequence illustrates how straws are inherently ejected only one at a time with succeeding straws falling into position to be ejected only after the traversing head completes its cycles.
Figure 35:
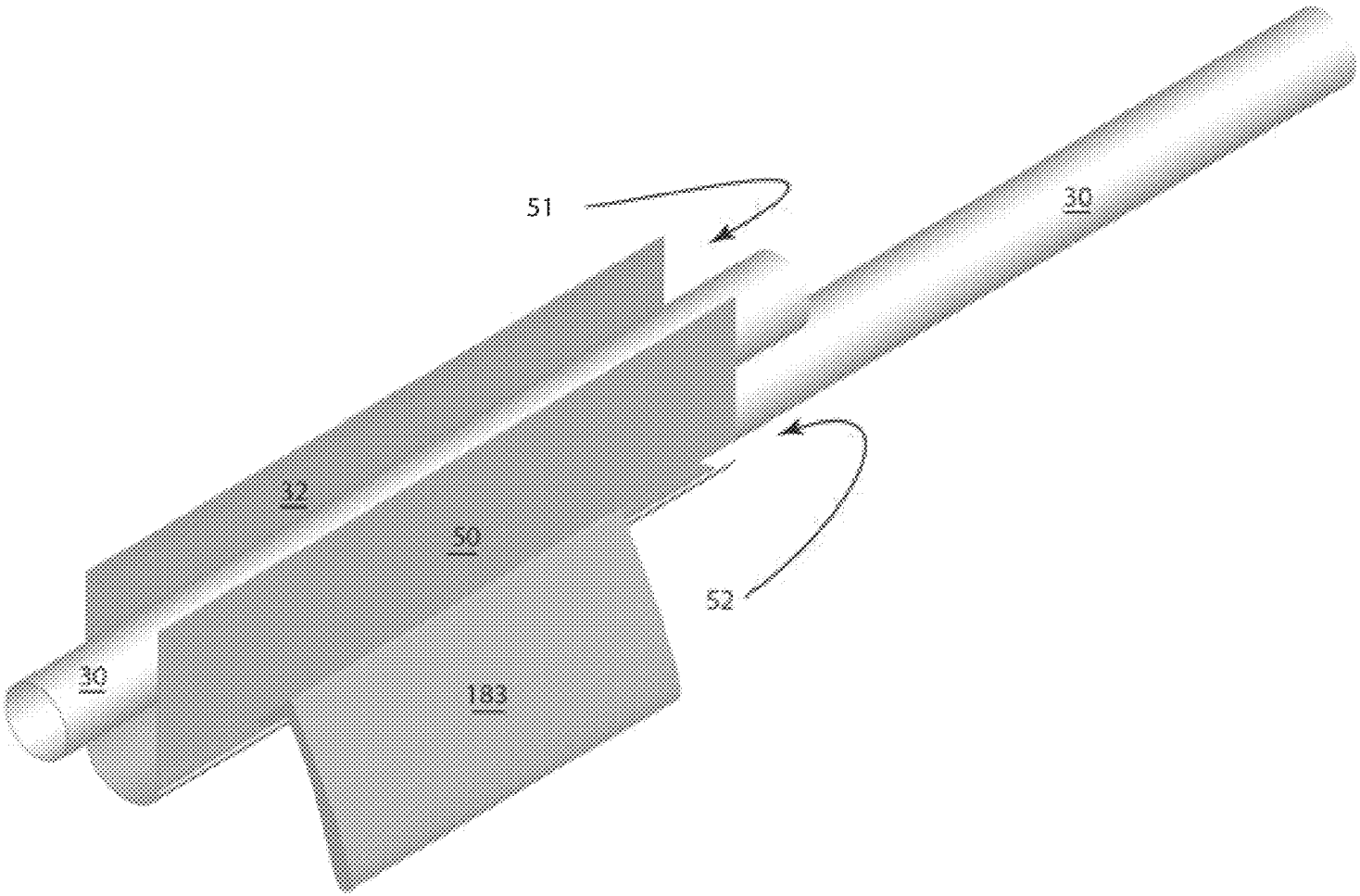
Figure 36:
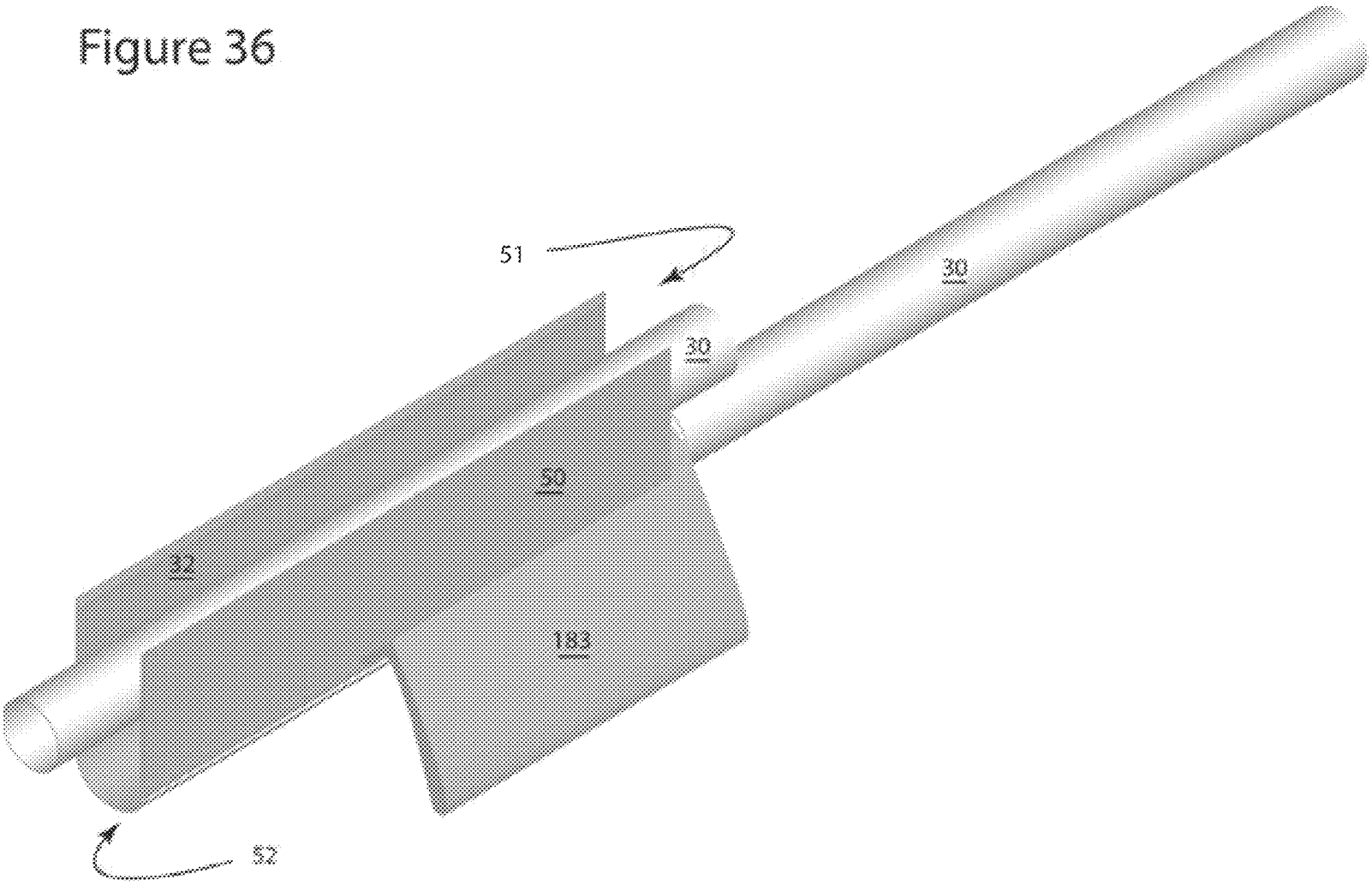
Figure 37:
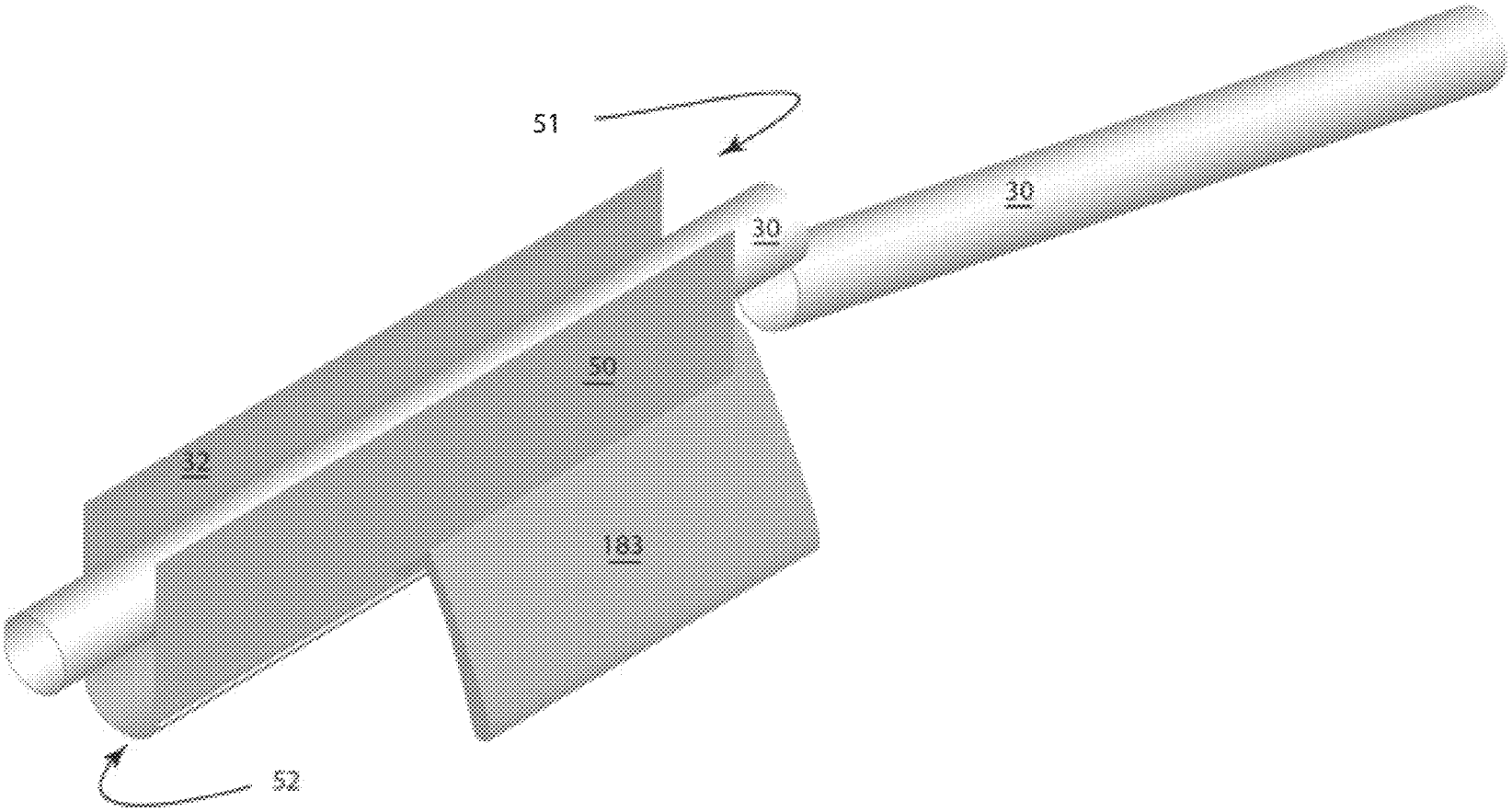
Figure 38:
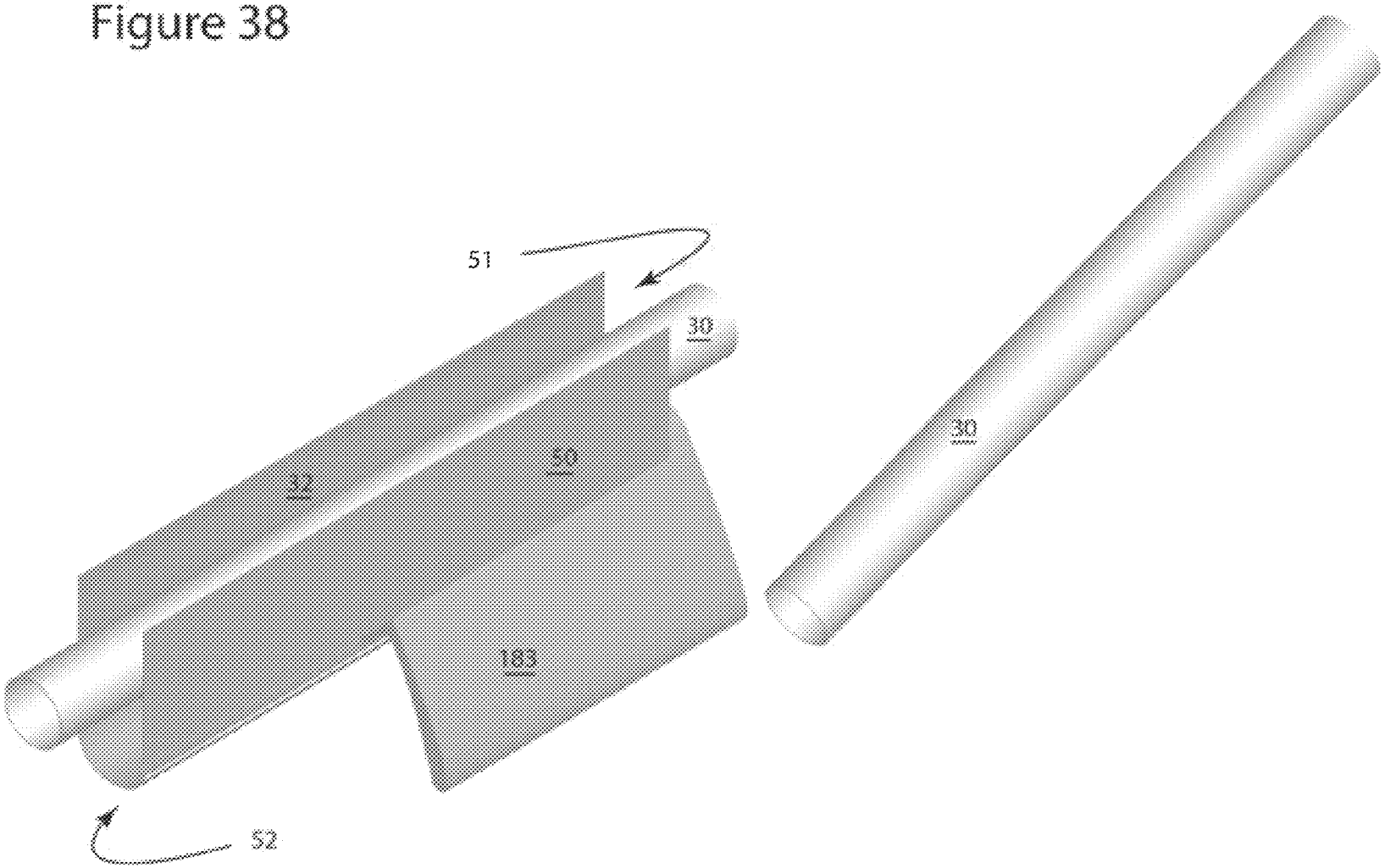
Figure 39:
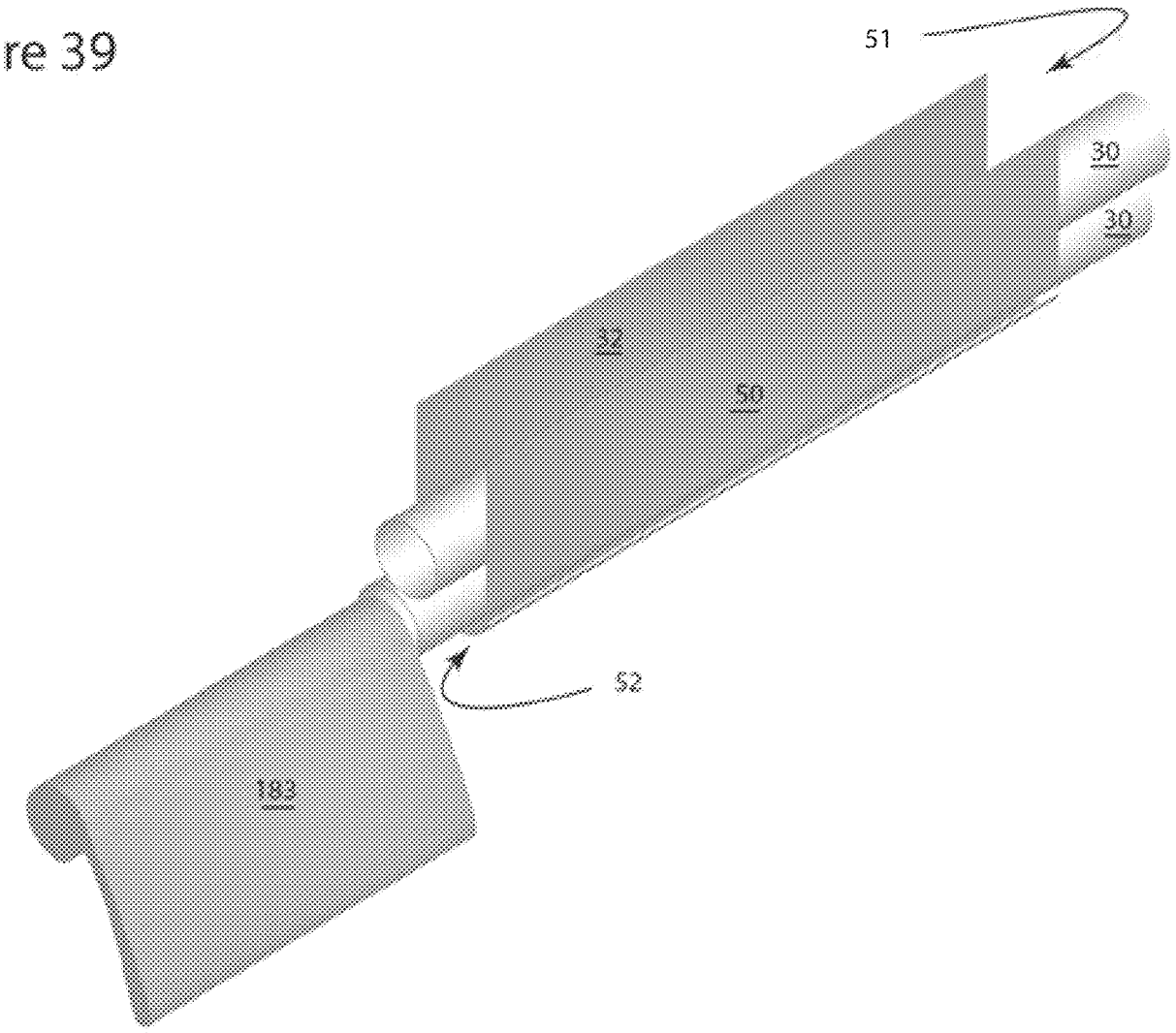

FIGS. 34-39 illustrate details of the interaction between straws 30 in stacking slot 51, defined between sidewalls 32 and 50, as traversing head 183 traverses dispensing slot 52 to dispense straws 30 seriatim. In FIG. 34, two straws 30 are stacked one atop another in stacking slot 51 while traversing head 183 is in its rearmost position engaging rear detection switch 199 (not shown in this sequence). Upon receipt of a signal to dispense another straw 30, traversing head 183 moves forwardly forcing lower straw 30 out of stacking slot 51, through dispensing aperture 24 (see FIG. 28). As straw 30 clears slot 51 (FIGS. 35 and 36), the rear of straw 30 is no longer supported by sidewall 32 lower lip and begins to fall into dispensing tray 34 (FIGS. 37 and 38), while the forwardmost portion of straw 30 above it still rests upon traversing head 183. After traversing head 183 engages forward limit switch 199, it moves rearwardly until it engages rear limit switch 199 and straw 30 above it can now fall into position to be dispensed as shown in FIG. 39.

FIG. 40 is a flow diagram illustrating the logic by which movement of traversing head 183 is controlled in response to activation of the two limit switches 199 and the straw detection sensor deployed in tray 34.

Figure 41:
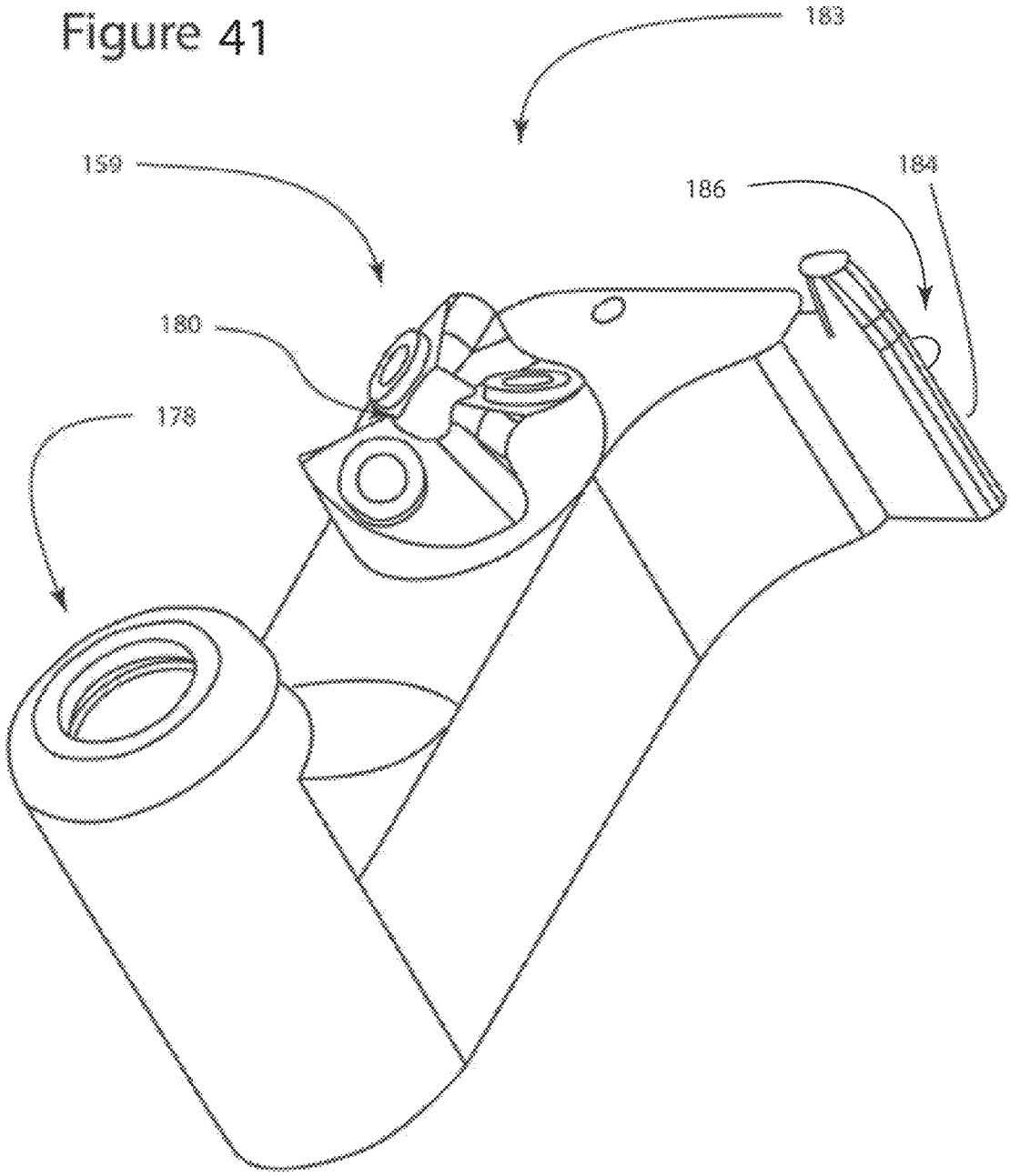
FIG. 41 is an isometric perspective of a traversing head having an upwardly extending protuberance to impart a rocking motion to straws stacked in the dispensing slot.

FIG. 41 illustrates an alternative traversing head having upwardly extending protuberance 186 formed on pusher rod 184. Upwardly extending protuberance 186 imparts a rocking motion to straws 30 thereabove as it transits the length of slot 52 helping to agitate them to ensure that they fall into position properly for dispensing. Another method of agitating straws 30 includes the hopper vibrator 29 discussed above.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. An automated dispenser for straws, comprising:

a housing having:

an anterior outer wall having a dispensing aperture defined therein;

a hopper defined therein said hopper being spaced rearwardly from said anterior outer wall;

said hopper having:

a generally prismatic upper section defined by transverse walls joined by longitudinal walls, said generally prismatic upper section of said hopper having a longitudinal dimension exceeding the length of the straws to be dispensed and a transverse dimension of less than the length of the straws to be dispensed, the longitudinal walls converging inwardly below said generally prismatic upper section and defining a stacking slot therebetween, the stacking slot having a width of less than two diameters of the straws to be dispensed but exceeding the diameter of the straws to be dispensed, the stacking slot having a length in excess of the straws to be dispensed;

a substantially horizontal support adapted to support a column of straws lying beneath said stacking slot;

an anterior inner wall spanning the longitudinal walls defining the stacking slot, said anterior inner wall having an ejection opening therethrough configured to allow passage of a straw therethrough, the anterior inner wall having a channel formed therein adjoining said ejection opening, one of said longitudinal walls defining said stacking slot having a longitudinally extending channel formed therein spanning the length of said longitudinal wall, said longitudinally extending channel adjoining said ejection opening in said anterior inner wall;

a posterior wall spanning the longitudinal walls defining the stacking slot, said posterior wall having an access opening therethrough configured to prevent passage of a straw therethrough, the posterior wall having a channel formed therein adjoining said access opening, and adjoining the longitudinally extending channel formed in said one of said longitudinal walls defining said stacking slot;

a translating drive belt disposed within said housing, exterior to said stacking slot having a support member connected therewith, said support member being locatable within said longitudinally extending slot and translatable down the length thereof, said support member being capable of passing through said longitudinally extending channel and said ejection opening defined in said anterior inner wall and said access opening defined in said posterior wall;

a pressing foot attached to said support member, said pressing foot having a vertically extending dimension less than the diameter of the straws to be dispensed and a horizontally extending dimension greater than the diameter of the straws to be dispensed, said pressing foot being locatable within said stacking slot and capable of translation longitudinally therein, said pressing foot being capable of passing through said ejection opening as well as through said access opening; and a guide tray disposed within said housing longitudinally forward of and below said ejection opening, said guide tray having a forwardly positioned location zone, a posterior wall longitudinally rearward of and below said ejection opening, said posterior wall adjoining said forwardly positioned location zone and an anterior wall sloping ascendingly and forwardly from the junction of said posterior wall and said forwardly positioned location zone toward said anterior outer wall of said housing, said guide tray defining a guide surface urging straws into said dispensing aperture and projecting upwardly therefrom.

2. The automated dispenser for straws of claim 1, further comprising: a sensor for detecting the absence of a straw in said forwardly positioned location zone, and means for advancing a straw from within the stacking slot into said guide tray in response to absence of a straw in said forwardly positioned location zone.

3. The automated dispenser for straws of claim 2, wherein said means for advancing a straw from within the stacking slot into said guide tray comprises an endless belt translating in a vertical plane, said pressing foot being connected to said endless belt, and a motor for advancing said endless belt, said endless belt lying substantially horizontally adjacent to said substantially horizontal support.

4. The automated dispenser for straws of claim 3, wherein said motor for advancing said endless belt lies above said belt.

5. The automated dispenser for straws of claim 3, wherein said motor for advancing said endless belt lies below said belt.

6. The automated dispenser for straws of claim 2, wherein a time delay is provided between detection of an absence of a straw in said guide tray and advancement of a straw into said forwardly positioned location zone.

7. The automated dispenser for straws of claim 6, wherein said automated dispenser comprises: an agitator adapted to impart kinetic energy to straws stored within said hopper, a door above said hopper; a switch for detecting when said hopper is closed, and a controller for activating said agitator in response to closure of said door.

8. The automated dispenser for straws of claim 7, wherein said controller is programmed to activate said agitator if, after activation of said means for advancing a straw from within the stacking slot into said guide tray in response to absence of a straw in said forwardly positioned location zone, no straw is thereafter detected within said guide tray.

9. The automated dispenser for straws of claim 8, wherein said controller is programmed to activate said agitator and thereafter re-activate said means for advancing a straw from within the stacking slot into said guide tray if, after activation of said means in response to absence of a straw in said forwardly positioned location zone, no straw is thereafter detected within said guide tray.

10. The automated dispenser for straws of claim 9, wherein said controller is programmed to repeatedly, for a predetermined number of cycles, re-activate said agitator and thereafter re-activate said means for advancing a straw from within the stacking slot into said guide tray if, after activation of said means in response to absence of a straw in said forwardly positioned location zone, no straw is thereafter detected within said guide tray, and wherein said guide tray and said dispensing aperture are positioned such that when said straw is within said dispensing aperture and projecting upwardly therefrom, the straw does not touch any portion of the dispenser which is manually accessible to users thereof.

11. The automated dispenser for straws of claim 2, wherein said guide tray and said dispensing aperture in said anterior outer wall are disposed such that the straw projecting through said dispensing aperture does not touch any portion of the dispenser which is manually accessible to users thereof.

12. An automated dispenser for straws, comprising:

a housing having:

an anterior outer wall having a dispensing aperture defined therein;

a hopper defined therein, said hopper being spaced rearwardly from said anterior outer wall;

said hopper having:

an upper section adapted to receive and hold an assemblage of straws, said upper section having longitudinal walls converging inwardly below said upper section and defining a stacking slot adapted to receive straws and support straws within said stacking slot, said stacking slot having a width of less than two straw diameters;

an anterior inner wall athwart the stacking slot, said anterior inner wall having an ejection opening therethrough configured to allow passage of a straw therethrough;

means for ejecting straws from said ejection opening; and a guide tray disposed within said housing below said ejection opening, said guide tray being adapted to receive straws ejected from said ejection opening and defining a guide surface urging straws into a position within said dispensing aperture projecting upwardly therefrom by action of gravity.

13. The automated dispenser for straws of claim 12, wherein said guide tray and said dispensing aperture are positioned such that when said straw is within said dispensing aperture and projecting upwardly therefrom, the straw does not touch any portion of the dispenser which is manually accessible to users thereof.

14. The automated dispenser for straws of claim 13, further comprising: a sensor for detecting the absence of a straw projecting from said dispenser through said dispensing aperture, and means for advancing a straw from within the stacking slot into said guide tray in response to absence of a straw projecting from said dispenser through said dispensing aperture.

15. The automated dispenser for straws of claim 14, wherein a time delay is provided between detection of an absence of a straw projecting from said dispenser through said dispensing aperture and advancement of a straw into said guide tray.

16. The automated dispenser for straws of claim 15, wherein said automated dispenser comprises: a vibrator attached to said hopper adapted to impart kinetic energy to straws stored within said hopper, a door above said hopper; a switch for detecting when said hopper is closed, and a controller for activating said vibrator for a period of time in response to closure of said door.

17. The automated dispenser for straws of claim 15, wherein said automated dispenser comprises: an agitator adapted to impart kinetic energy to straws stored within said hopper and a controller for activating said vibrator, wherein said controller is programmed to activate said agitator if, after activation of said means for advancing a straw from within the stacking slot into said guide tray in response to absence of a straw in said forwardly positioned location zone, no straw is thereafter detected within said guide tray.

18. The automated dispenser for straws of claim 17, wherein said controller is programmed to activate said agitator and thereafter re-activate said means for advancing a straw from within the stacking slot into said guide tray if, after activation of said means in response to absence of a straw in said forwardly positioned location zone, no straw is thereafter detected within said guide tray.

19. The automated dispenser for straws of claim 18, wherein said controller is programmed to repeatedly, for a predetermined number of cycles, re-activate said agitator and thereafter re-activate said means for advancing a straw from within the stacking slot into said guide tray if, after activation of said means in response to absence of a straw in said forwardly positioned location zone, no straw is thereafter detected within said guide tray, and wherein said guide tray and said dispensing aperture are positioned such that when said straw is within said dispensing aperture and projecting upwardly therefrom, the straw does not touch any portion of the dispenser which is manually accesible to users thereof.

20. The automated dispenser for straws of claim 19, wherein said controller is programmed to present an error signal if no straw is detected within said guide tray after said predetermined number of cycles.

21. The automated dispenser for straws of claim 12, further comprising a non-contact sensing mechanism for detecting the presence of a hand in front of said anterior outer wall and means for initiating a straw dispensing in response thereto.

22. The automated dispenser for straws of claim 21, further comprising at least one guide wall above said guide tray defining a chute positioned to direct straws ejected from said ejection opening through said dispensing aperture.

23. The automated dispenser for straws of claim 12, further comprising at least one guide wall above said guide tray defining a chute positioned to direct straws ejected from said ejection opening through said dispensing aperture.

* * * * *